US006925657B2

(12) United States Patent
Takahashi et al.

(10) Patent No.: US 6,925,657 B2
(45) Date of Patent: Aug. 9, 2005

(54) HEAD PROTECTING BODY FOR SAFETY HELMET AND SAFETY HELMET HAVING HEAD PROTECTING BODY

(75) Inventors: Masami Takahashi, Inashiki-gun (JP); Shinichi Uchiyama, Namekata-gun (JP)

(73) Assignee: SHOEI, Co., Ltd., Tokyo (JP)

( * ) Notice: Subject to any disclaimer, the term of this patent is extended or adjusted under 35 U.S.C. 154(b) by 186 days.

(21) Appl. No.: 10/635,993

(22) Filed: Aug. 7, 2003

(65) Prior Publication Data

US 2004/0025229 A1 Feb. 12, 2004

(30) Foreign Application Priority Data

Aug. 9, 2002 (JP) ..... 2002-234030

(51) Int. Cl.[7] ..... A42B 3/00
(52) U.S. Cl. ..... 2/412; 2/424
(58) Field of Search ..... 2/410, 411, 412, 2/414, 424, 425, 171.3

(56) References Cited

U.S. PATENT DOCUMENTS 3,501,772 A * 3/1970 Wyckoff ..... 2/421
4,006,496 A * 2/1977 Marker ..... 2/414
4,115,874 A * 9/1978 Hasegawa ..... 2/425
4,555,816 A * 12/1985 Broersma ..... 2/425
5,136,728 A * 8/1992 Kamata ..... D25/124

FOREIGN PATENT DOCUMENTS

| | | | | |
|---|---|---|---|---|
| EP | 0571065 | | 5/1997 | |
| EP | 0771534 | | 9/2001 | |
| GB | 2226489 A | * | 7/1990 | ..... A42B/3/28 |
| JP | 05044102 A | * | 2/1993 | ..... A42B/3/28 |

* cited by examiner

*Primary Examiner*—Rodney M. Lindsey
(74) *Attorney, Agent, or Firm*—Jones Day

(57) ABSTRACT

A head protecting body for a safety helmet, in which a first liner member for an impact-on-the-head absorbing liner includes a swell for reinforcing at least one region of a forehead region, a left temple region, a right temple region and an occiput region in an overlapping region with respect to a second liner member having a density lower than that of the first liner member, on an overlapping surface side of the first liner member, and the second liner member includes a hollow having a shape substantially corresponding to the swell. According to this head protecting body, despite that the impact-on-the-head absorbing liner is not broken easily more than necessary near a region reinforced with the reinforcing swell, both the maximum acceleration during impact and an HIC can be decreased effectively.

97 Claims, 21 Drawing Sheets

HEAD PROTECTING BODY FOR SAFETY HELMET AND SAFETY HELMET HAVING HEAD PROTECTING BODY

PRIORITY CLAIM

This application claims the benefit of Japanese Patent Application No. 2002-234030, filed on Aug. 9, 2002.

1. Technical Field

This invention relates to a head protecting body for a safety helmet, which has an outer shell made of a rigid material and an impact-on-head absorbing liner arranged inside the outer shell, and a safety helmet having such a head protecting body.

2. Background of the Invention

A safety helmet such as a full-face-, jet-, or semi-jet-type helmet, which has a head protecting body and is to be worn on the head of a helmet wearer (to be merely referred to as a "wearer" hereinafter) such as the rider of a motor cycle to protect his/her head is conventionally known. The conventional full-face-, jet-, or semi-jet-type helmet usually has a head protecting body and a pair of left and right chin straps attached inside the head protecting body, and is typically formed in the following manner.

More specifically, the head protecting body has a window opening (in the case of a full-face-type helmet) or notch (in the case of a jet- or semi-jet-type helmet) formed in its front surface to oppose a portion between the forehead and chin (that is, the face) of the wearer. The full-face-type helmet further has a shield plate attached to the head protecting body such that it can move between a lower position where it closes the window opening and an upper position where it opens the window opening. The jet- or semi-jet-type helmet further has a visor attached to the head protecting body along near the upper rim of the notch. The jet- or semi-jet-type helmet can also have a shield plate, e.g., in place of the visor. In this case, the shield plate can open/close the notch.

The head protecting body is made up of an outer shell forming the circumferential wall of the head protecting body, a rim member, and a backing member attached to the outer shell by adhesion or the like in contact with the inner surface of the outer shell. The rim member is attached to the rim of the outer shell by adhesion or the like throughout the rim of the outer shell (including the entire peripheral portion around the rim of the window opening in the case of the full-face-type helmet) to clamp the rim of the outer shell. The backing member includes a backing member for the head having a sinciput region (i.e., forehead region), a vertex region, left and right temple regions and an occiput region respectively corresponding to the sinciput part (i.e., forehead), vertex part, left and right temple parts and occiput part of the head of the wearer. In the case of the full-face-type helmet, the backing member further includes a backing member for the chin and cheeks which respectively corresponds to the chin and cheeks of the wearer. In the case of the jet- or semi-jet-type helmet, the backing member further includes a pair of left and right backing members for the ears which oppose the pair of left and right ears of the wearer, or a backing member for the head integrated with the backing members for the ears.

The backing member for the head is constituted by an impact-on-the-head absorbing liner and an air-permeable backing cover for the head. The backing cover for the head is so attached to the impact-on-the-head absorbing liner by adhesion or taping to cover the inner surface (depending on the case, excluding part of the vertex region opposing the vertex part of the head of the wearer) and the side surfaces (i.e., narrow surfaces extending along the direction of thickness between the inner and outer surfaces), and the circumferential rim portion of the outer surface continuous to the side surfaces of the impact-on-the-head absorbing liner. The impact-on-the-head absorbing liner is made of a foamed body of a synthetic resin such as polystyrene, polypropylene, or polyethylene.

The backing member for the chin has substantially the same structure as that of the backing member for the head except that it has a shape opposing the chin of the wearer. A pair of left and right blockish inner pads are adhered to part of the inner surface of an impact-on-the-chin absorbing liner (e.g., left and right cheek regions made up of two regions respectively opposing the left and right cheeks of the wearer) when necessary. Hence, the blockish inner pads are arranged between the impact-on-the-chin absorbing liner and the backing cover for the chin. Each backing member for the ear also has substantially the same structure as that of the backing member for the head or the backing member for the chin except that it has a shape opposing the ear of the wearer.

Typically, in the conventional safety helmet having the above arrangement, when an impact is applied to the region of part of the outer shell, the outer shell disperses the impact over a wide range and absorbs the impact energy by deforming its outer shape. The impact absorbing liner absorbs the impact energy propagating from the outer shell by deforming its outer shape, absorbs the impact energy by decreasing its thickness (i.e., compression) and delays propagation of the impact energy to the head of the wearer. Hence, the impact absorbing liner serves to decrease the maximum acceleration caused by the impact. In this specification, the "maximum acceleration" signifies the maximum value of the acceleration obtained by the "impact absorption test" of the helmet.

To confirm the protection performance of the safety helmet, the "impact absorption test" for the helmet as described above has conventionally been performed. In the "impact absorption test", as the model of the head of the wearer, a metal head dummy with an accelerometer attached in it is used. The standard for the maximum acceleration measured by the accelerometer is determined differently in different countries. An index called HIC (Head Injury Criteria) is proposed on the basis of the interrelation among the average acceleration during a certain arbitrary time and the time during which a value equal to or exceeding the average acceleration continues, and the damage to the human brain. The HIC is determined in the following manner:

$$HIC = \left[\frac{1}{t2 - t1} \times \int_{t1}^{t2} a(t)\,dt\right]^{2.5} \times (t2 - t1)$$

where a(t) is the change over time of the acceleration value during the impact test, and t1 and t2 are arbitrary time points where HIC is the maximum.

The HIC is said to have a good interrelation with the degree of the damage of an accident. According to the British Transport and Road Research Laboratory, Mr. P. D. Hope et al., in an accident of a motor bicycle, when the HIC is 1,000, the death rate is 8.5%. When the HIC is 2,000, the death rate is 31%. When the HIC is 4,000, the death rate is 65%. Consequently, to decrease the degree of the damage, it is necessary to decrease the HIC.

As described above, to increase the protection performance of the safety helmet, it is necessary to decrease both the maximum acceleration caused by the impact and the HIC. For this purpose, conventionally, the thickness of the impact absorbing liner is increased, so that the maximum acceleration and the HIC are decreased.

If, however, the thickness of the impact absorbing liner is merely increased, not only the maximum acceleration is not decreased sufficiently, but also it is particularly difficult to decrease the HIC. This is due to the following reason. As the HIC includes a time during which an acceleration equal to or exceeding a predetermined value continues, even if the maximum acceleration can be somewhat decreased by the cushion operation of the impact absorbing liner, the time during which the acceleration equal to or exceeding the predetermined value continues cannot be shortened, and accordingly the HIC cannot be decreased.

In view of this, the present applicant (i.e., the present assignee) previously proposed a head protecting body for a safety helmet, which can decrease both the maximum acceleration during an impact and the HIC without particularly decreasing the rigidity of the entire impact-on-the-head absorbing liner and which can perform ventilation well, as described in EP 0 771 534 B1.

EP 0 771 534 B1 discloses a head protecting body for a safety helmet (to be referred to as the "antecedent head protecting body" in this specification), which has an outer shell made of a rigid material and an impact-on-the-head absorbing liner arranged inside the outer shell. In the antecedent head protecting body, the impact-on-the-head absorbing liner has a main liner member and an inner auxiliary liner member with a lower density than that of the main liner member. An inner recess is formed in the inner surface of the main liner member, and the inner auxiliary liner member is arranged in the inner recess. In the antecedent head protecting body, according to one of its embodiments, the impact-on-the-head absorbing liner further has an outer auxiliary liner member with an intermediate density between the density of the main liner member and that of the inner auxiliary liner member. An outer recess is formed in the outer surface of the main liner member, and the outer auxiliary liner member is arranged in the outer recess. Furthermore, a ventilation hole is formed between the main liner member and the outer auxiliary liner member. A communicating means for allowing the ventilation hole and the outer surface of the substantially hemispherical vertex region of the outer shell to communicate with each other, and a communicating means for allowing the ventilation hole and a head accommodating space of the impact-on-the-head absorbing liner to communicate with each other are provided.

In the antecedent head protecting body, the inner auxiliary liner member and the inner recess are provided to the vertex region of the impact-on-the-head absorbing liner, and the outer auxiliary liner member and the outer recess extend from the forehead region to the occiput region through the vertex region of the impact-on-the-head absorbing liner. Therefore, because of the presence of the inner auxiliary liner member and the outer auxiliary liner member, in the forehead, vertex and occiput regions of the impact-on-the-head absorbing liner, the outer shape of the impact-on-the-head absorbing liner deforms effectively by the impact to disperse and absorb the impact energy and to effectively decrease its thickness, so that the impact energy is absorbed. Thus, a helmet having the antecedent head protecting body can decrease both the maximum acceleration during an impact and the HIC.

In the antecedent head protecting body, if the thickness of the outer auxiliary liner member is increased in order to decrease both the maximum acceleration during an impact and the HIC as effectively as possible, the strength of the forehead region, of the impact-on-the-head absorbing liner, which has a comparatively small strength, decreases more than necessary. As a result, the impact-on-the-head absorbing liner tends to be broken easily more than necessary near the forehead region. This is not preferable.

If the thickness of the outer auxiliary liner member is decreased so that the strength of the forehead region is prevented from decreasing more than necessary, the effect of decreasing both the maximum acceleration during the impact and the HIC by means of the outer auxiliary liner member decreases particularly in the vertex region and occiput region.

SUMMARY OF THE INVENTION

It is, therefore, the main object of this invention to decrease both the maximum acceleration during an impact and the HIC effectively in the antecedent head protecting body while preventing the strength of the forehead region of the impact-on-the-head absorbing liner from decreasing more than necessary.

According to this invention, there is provided a head protecting body for a safety helmet, comprising an outer shell made of a rigid material and an impact-on-the-head absorbing liner arranged inside the outer shell, the impact-on-the-head absorbing liner comprising a first liner member, and a second liner member having a density lower than that of the first liner member and stacked on (i.e., overlapping with) the first liner member at least partially, wherein the first liner member comprises a swell for reinforcing at least one region of a forehead region, a left temple region, a right temple region and an occiput region in a stacking region (i.e., an overlapping region) with respect to the second liner member on a stacking surface side (i.e., an overlapping surface side) of the first liner member, the swell having a thickness larger than that of a portion of the first liner member which excludes the swell in the overlapping region, the second liner comprises a hollow having a shape substantially corresponding to the swell in a stacking region (i.e., an overlapping region) with respect to the first liner member, the hollow has a thickness smaller than that of a portion of the second liner member which excludes the hollow of the overlapping region, and the swell is fitted in the hollow. According to this invention with the above arrangement, the strength of that region of the impact-on-the-head absorbing liner which is reinforced by the reinforcing swell does not decrease very much. The outer shape of the impact-on-the-head absorbing liner deforms effectively by an impact, so that the impact energy is dispersed and absorbed effectively, and the thickness of the impact-on-the-head absorbing liner decreases effectively. Thus, the impact energy is absorbed effectively. Although the impact-on-the-head absorbing liner is not broken easily more than necessary near the reinforced region, both the maximum acceleration during the impact and the HIC can be decreased effectively.

According to this invention, the swell can be formed only within a region formed of the forehead region and a front half of a vertex region. The swell can be formed only within the forehead region. The swell can include a forehead region reinforcing swell.

According to this invention, the first liner member and the second liner member can be both made of a foamed body of a synthetic resin, and a percentage of a density of the second liner member to a density of the first liner member can fall within a range of 25% to 85%, and preferably within a range of 35% to 75%. A density of the first liner member can fall within a range of 20 g/liter to 70 g/liter, and preferably within a range of 30 g/liter to 60 g/liter. A density of the second liner member can fall within a range of 5 g/liter to 45 g/liter, and preferably within a range of 10 g/liter to 40 g/liter. The main liner member can comprise a single molded product made of a synthetic resin foamed body.

According to the first aspect of this invention, the first liner member comprises a main liner member, the second liner member comprises an auxiliary liner member, a surface recess (i.e., an outer recess or an inner recess) having a shape substantially corresponding to that of the auxiliary liner member is formed in a surface (i.e., an outer surface or an inner surface) of the main liner member, and the auxiliary liner member is placed in the outer surface recess.

According to the second aspect of this invention, in the first aspect, the main liner member comprises a composite main liner member comprising a main liner member main body having a central opening or central recess and a second auxiliary liner member having a density lower than that of the main liner member main body and placed in the central opening or central recess, and the swell is formed substantially on the main liner member main body.

According to the first and second aspects, the auxiliary liner member can comprise a single molded product made of a synthetic resin foamed body. The surface recess can comprise an outer recess formed in an outer surface of the main liner member. The surface recess can comprise an inner recess formed in an inner surface of the main liner member. Both of the auxiliary liner member and the surface recess can extend from the forehead region to the occiput region through a vertex region of the impact-on-the-head absorbing liner, and both of the swell and the hollow can be formed substantially in the forehead region.

According to the third aspect of this invention, in the first and second aspects, the swell comprises a tableland, a thickness of which changes relatively small or does not change substantially, and a first thickness transient region extending from the tableland toward a vertex region such that a thickness of the main liner member decreases, and the hollow comprises a lowland, a thickness of which changes comparatively small or does not change substantially, and a second thickness transient region extending from the lowland toward the vertex region such that a thickness of the auxiliary liner member increases.

According to the first to third aspects, a developed length (i.e., a development length) between a lower end of the forehead region of the main liner member and a front end of the surface recess on a central plane in a left-to-right direction of the impact-on-the-head absorbing liner can fall within a range of 0.5 cm to 4.5 cm, and preferably within a range of 1 cm to 3 cm. A development length between a lower end of occiput head region of the main liner member and a rear end of the surface recess on a central plane in a left-to-right direction of the impact-on-the-head absorbing liner can fall within a range of 1 cm to 12 cm, and preferably within a range of 2.5 cm to 5.8 cm. Furthermore, a development length between a lower end of the left temple region of the main liner member and a left side end of the surface recess, and a development length between a lower end of the right temple region of the main liner member and a right side end of the surface recess, on a central plane in a back-and-forth direction of the impact-on-the-head absorbing liner, both can fall within a range of 4 cm to 18 cm, and preferably within a range of 6 cm to 15 cm.

According to the first to third to third aspects, a development length of an open surface of the surface recess on a central plane in a left-to-right direction of the impact-on-the head absorbing liner can fall within a range of 20 cm to 55 cm, and preferably within a range of 30 cm to 50 cm. A development length of an open surface of the surface recess on a central plane in a left-to-right direction of the impact-on-the-head absorbing liner can fall within a range of 15 cm to 50 cm, and preferably within a range of 20 cm to 40 cm. Furthermore, development lengths in a left-to-right direction of front and rear ends of the surface recess can fall within a range of 8 cm to 26 cm, and preferably within a range of 12 cm to 22 cm.

According to the third aspect, average development lengths in a back-and-forth direction of the tableland and the lowland can fall within a range of 2.5 cm to 12 cm, and preferably within a range of 4 cm to 9 cm. Average development lengths in a left-to-right direction of the tableland and the lowland can fall within a range of 9 cm to 28 cm, and preferably within a range of 13 cm to 24 cm. Development lengths in a back-and-forth direction of the first and second thickness transient regions can fall within a range of 1 cm to 6 cm, and preferably within a range of 2 cm to 4.5 cm. Furthermore, development lengths in a left-to-right direction of the first and second thickness transient regions can fall within a range of 11 cm to 32 cm, and preferably within a range of 15 cm to 28 cm.

According to the third aspect, developed areas (i.e., development areas) of the tableland and the lowland can fall within a range of 50 $cm^2$ to 220 $cm^2$, and preferably within a range of 75 $cm^2$ to 160 $cm^2$. Development areas of the first and second thickness transient regions can fall within a range of 25 $cm^2$ to 140 $cm^2$, and preferably within a range of 35 $cm^2$ to 100 $cm^2$. Furthermore, a development area of a portion of a bottom surface of the surface recess of the main liner member which excludes the swell, and a development area of a portion of a stacking side surface (i.e., an overlapping side surface) of the auxiliary liner member which excludes the hollow can fall within a range of 250 $cm^2$ to 1,000 $cm^2$, and preferably within a range of 400 $cm^2$ to 800 $cm^2$.

According to the third aspect, a ratio of a development area of the swell to a development area of a portion of a bottom surface of the surface recess of the main liner member which excludes the swell, and a ratio of a development area of the hollow to a development area of a portion of the overlapping side surface of the auxiliary liner member which excludes the hollow can fall within a range of 0.1 to 0.6, and preferably within a range of 0.15 to 0.45. A ratio of a development area of the tableland to a development area of a portion of a bottom surface of the surface recess of the main liner member which excludes the swell, and a ratio of a development area of the lowland to a development area of a portion of the auxiliary liner member which excludes the hollow can fall within a range of 0.06 to 0.5, and preferably within a range of 0.1 to 0.3. Furthermore, a ratio of a development area of the first thickness transient region to a development area of the tableland, and a ratio of a development area of the second thickness transient region to a development area of the lowland can fall within a range of 0.25 to 1.2, and preferably within a range of 0.35 to 0.9.

According to the first to third aspects, an average thickness of a portion of the main liner member which excludes a portion where the surface recess is formed can fall within a range of 1.5 cm to 8 cm, and preferably within a range of 2.5 cm to 6 cm. An average thickness of a portion of the surface recess of the main liner member which excludes a swell can fall within a range of 0.5 cm to 3 cm, and preferably within a range of 0.8 cm to 2.4 cm.

According to the third aspect, an average thickness of the tableland of the main liner member can fall within a range of 1 cm to 6 cm, and preferably within a range of 1.5 cm to 4.5 cm. An average thickness of a portion of the auxiliary liner member which excludes the hollow, and an average depth of a portion of the surface recess of the main liner member which excludes the swell can fall within a range of 0.8 cm to 5 cm, and preferably within a range of 1.4 cm to 4 cm. Furthermore, an average thickness of a lowland of the auxiliary liner member can fall within a range of 0.3 cm to 2 cm, and preferably within a range of 0.5 cm to 1.5 cm.

According to the third aspect, a ratio of an average thickness of the tableland to an average thickness of a portion of a bottom surface of the surface recess of the main liner member which excludes the swell can fall within a range of 1.2 to 4, and preferably within a range of 1.5 to 3. A ratio of an average thickness of the lowland to an average thickness of a portion of the auxiliary liner member which excludes the hollow can fall within a range of 1/5 to 4/5, and preferably within a range of 3/10 to 3/5. A ratio of an average thickness of a portion of the auxiliary liner member which excludes a hollow to an average thickness of a portion of the surface recess of the main liner member which excludes the swell can fall within a range of 1/2 to 4, and preferably within a range of 1 to 3. A ratio of an average thickness of the lowland of the auxiliary liner member to an average thickness of the tableland of the main liner member can fall within a range of 1/12 to 5/6, and preferably within a range of 1/6 to 2/3. Furthermore, a ratio of an average thickness of the tableland to an average thickness of a portion of the main liner member which excludes a portion where the surface recess is formed can fall within a range of 1/2 to 7/8, and preferably within a range of 2/3 to 5/6.

According to the second aspect, each of the main liner member main body and the second auxiliary liner member can be made of a foamed body of a synthetic resin, and a percentage of a density of the second auxiliary liner member to a density of the main liner member main body can fall within a range of 25% to 85%, and preferably within a range of 35% to 75%. Each of the auxiliary liner member and the second auxiliary liner member can be made of a foamed body of a synthetic resin, and a percentage of a density of the second auxiliary liner member to a density of the auxiliary liner member can fall within a range of 60% to 167%, and preferably within a range of 75% to 133%. A density of the main liner member main body can fall within a range of 20 g/liter to 70 g/liter, and preferably within a range of 30 g/liter to 60 g/liter. Furthermore, a density of the second auxiliary liner member can fall within a range of 5 g/liter to 45 g/liter, and preferably within a range of 10 g/liter to 40 g/liter.

According to the second aspect, a maximum value of a development length in a back-and-forth direction of the second auxiliary liner member and a maximum value of a development length in a back-and-forth direction of the central opening or central recess can fall within a range of 12 cm to 42 cm, and preferably within a range of 18 cm to 36 cm. A maximum value of a development length in a left-to-right direction of the second auxiliary liner member and a maximum value of a development length in a left-to-right direction of the central opening or central recess can fall within a range of 10 cm to 36 cm, and preferably within a range of 14 cm to 28 cm.

According to the second aspect, the swell can comprise a tableland, a thickness of which changes relatively small or does not change substantially, and a thickness transient region extending from the tableland toward a vertex region such that a thickness of the main liner member decreases, and a ratio of an average thickness of the tableland of the main liner member to an average thickness of a portion of the main liner member which excludes a portion where the surface recess is formed can fall within a range of 1/2 to 7/8, and preferably within a range of 2/3 to 5/6. A development area of an open surface of the central opening or central recess and a development area of a surface (i.e., an outer surface or an inner surface) of the second auxiliary liner member on a side corresponding to the open surface can fall within a range of 60 $cm^2$ to 600 $cm^2$, and preferably within a range of 100 $cm^2$ to 360 $cm^2$.

According to the second aspect, a ratio of a development area of a surface (i.e., an outer surface or an inner surface) of the second auxiliary liner member on a side opposite to the bottom surface to a development area of a portion of the bottom surface of the surface recess (i.e., an outer surface recess or an inner surface recess) of the composite main liner member which excludes a swell can fall within a range of 0.18 to 0.8, and preferably within a range of 0.25 to 0.60. An average thickness of the second auxiliary liner member and an average depth of the central opening or central recess can fall within a range of 0.5 cm to 3 cm, and preferably within a range of 0.8 cm to 2.4 cm. The central opening or central recess of the main liner member main body can comprise a central opening. Each one of the auxiliary liner member, the main liner member main body and the second auxiliary liner member can comprise a single molded product made of a synthetic resin foamed body.

According to this invention, the head protecting body can further comprise a ventilation hole formed by an inner surface of the outer shell and a ventilation ridge groove formed in the impact-on-the-head absorbing liner. The head protecting body can further comprise a ventilation hole formed by a ventilation ridge groove formed in the main liner member and/or a ventilation ridge groove formed in the auxiliary liner member. Furthermore, an average thickness of the outer shell can fall within a range of 1 mm to 6 mm, and preferably within a range of 2 mm to 5 mm.

Also, this invention relates to a safety helmet comprising a head protecting body as described above.

The above and other objects, features and advantages of this invention will become readily apparent from the following detailed description thereof which is to be read in connection with the accompanying drawings.

DETAILED DESCRIPTION OF THE INVENTION

The items of the first to third embodiments each obtained by applying this invention to a full-face-type helmet will be sequentially described separately with reference to the accompanying drawings.

1. First Embodiment

First, the first embodiment will be separated into items "(1) entire helmet", "(2) impact-on-the-head absorbing liner" and "(3) ventilator mechanism" and will be described with reference to FIGS. 1 to 14.

(1) Entire Helmet

Figure 1:
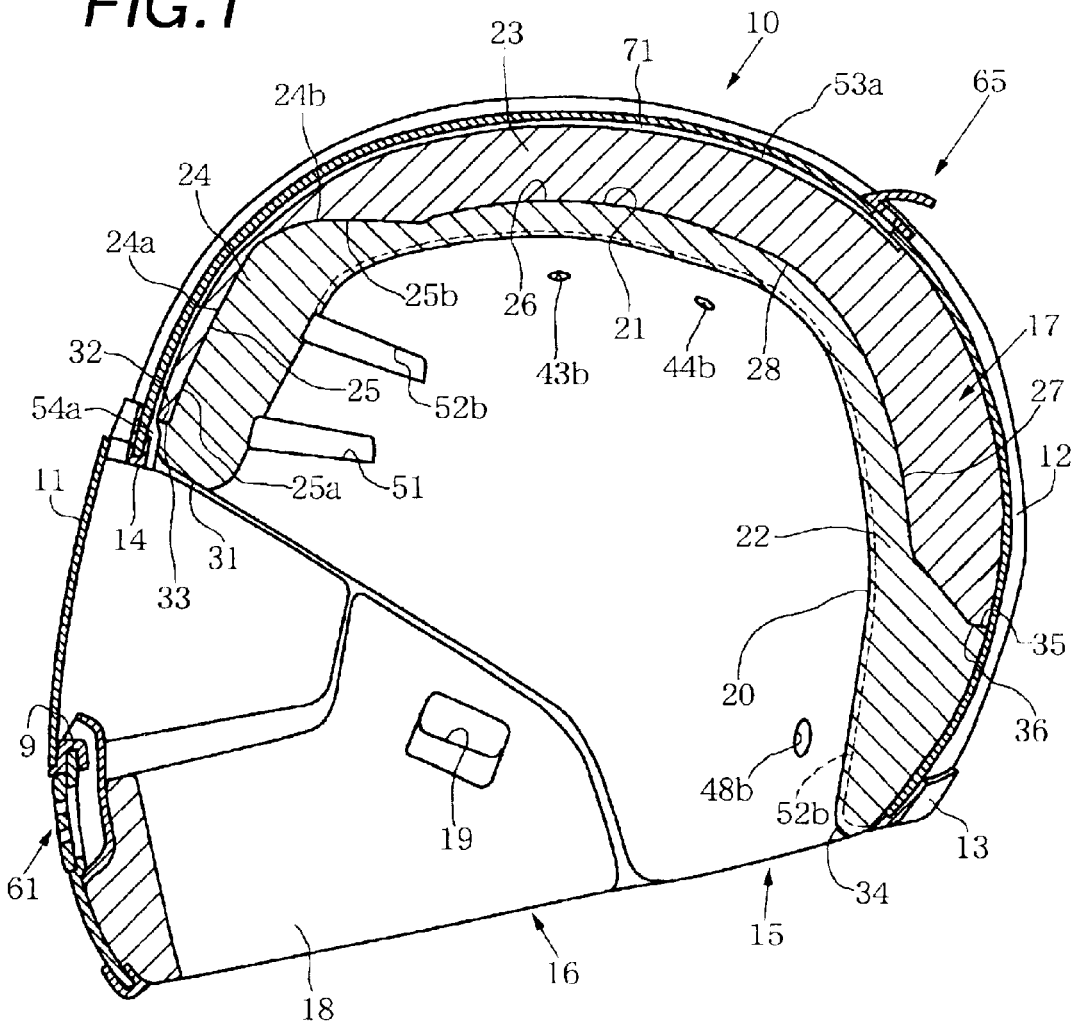
FIG. 1 is a longitudinal sectional view, taken along an outer surface ventilation hole, of a head protecting body according to the first embodiment obtained by applying this invention to a full-face-type helmet, from which a backing cover for the head and a backing cover for the chin and cheek are removed.
Figure 2:
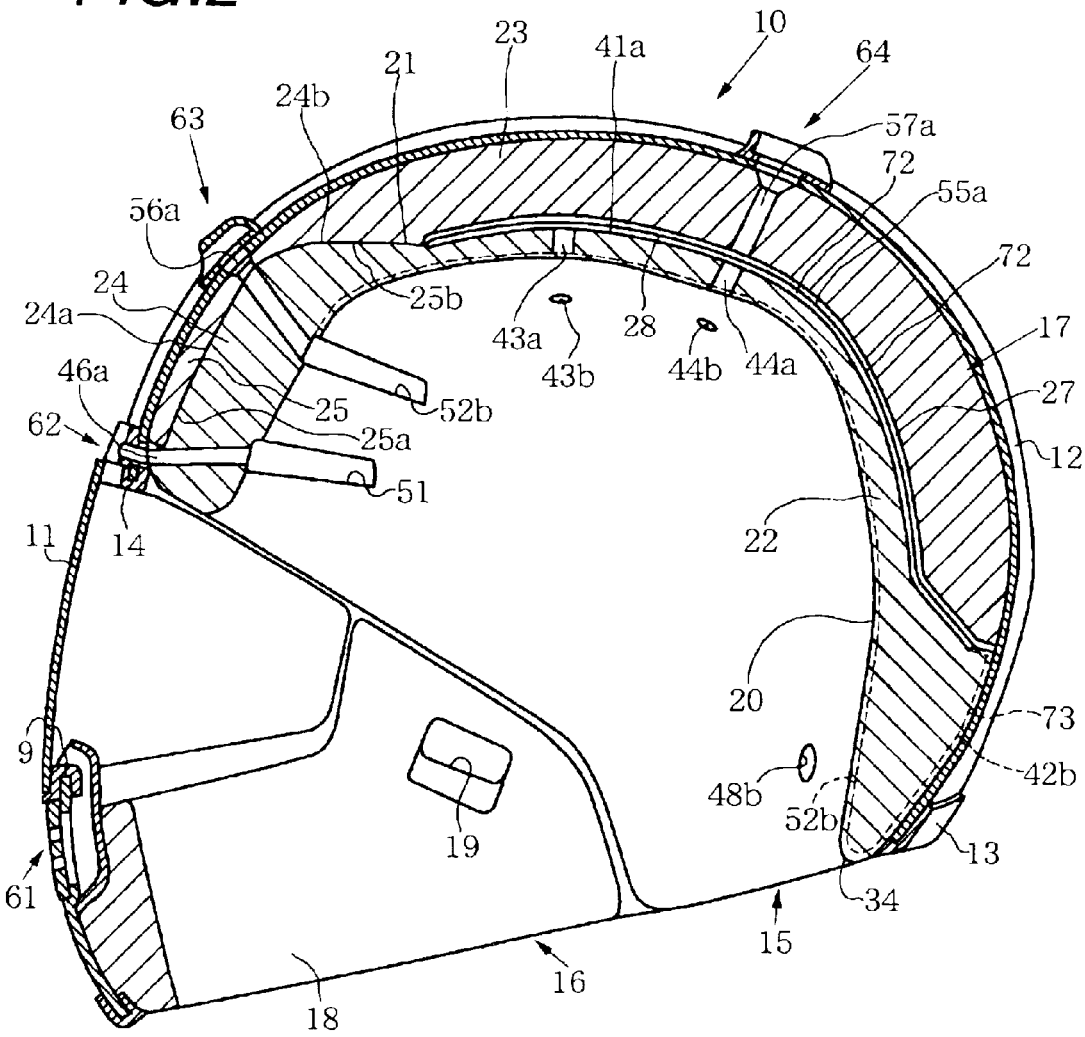
FIG. 2 is a longitudinal sectional view, taken along an intermediate ventilation hole, of the head protecting body shown in FIG. 1.
Figure 3:
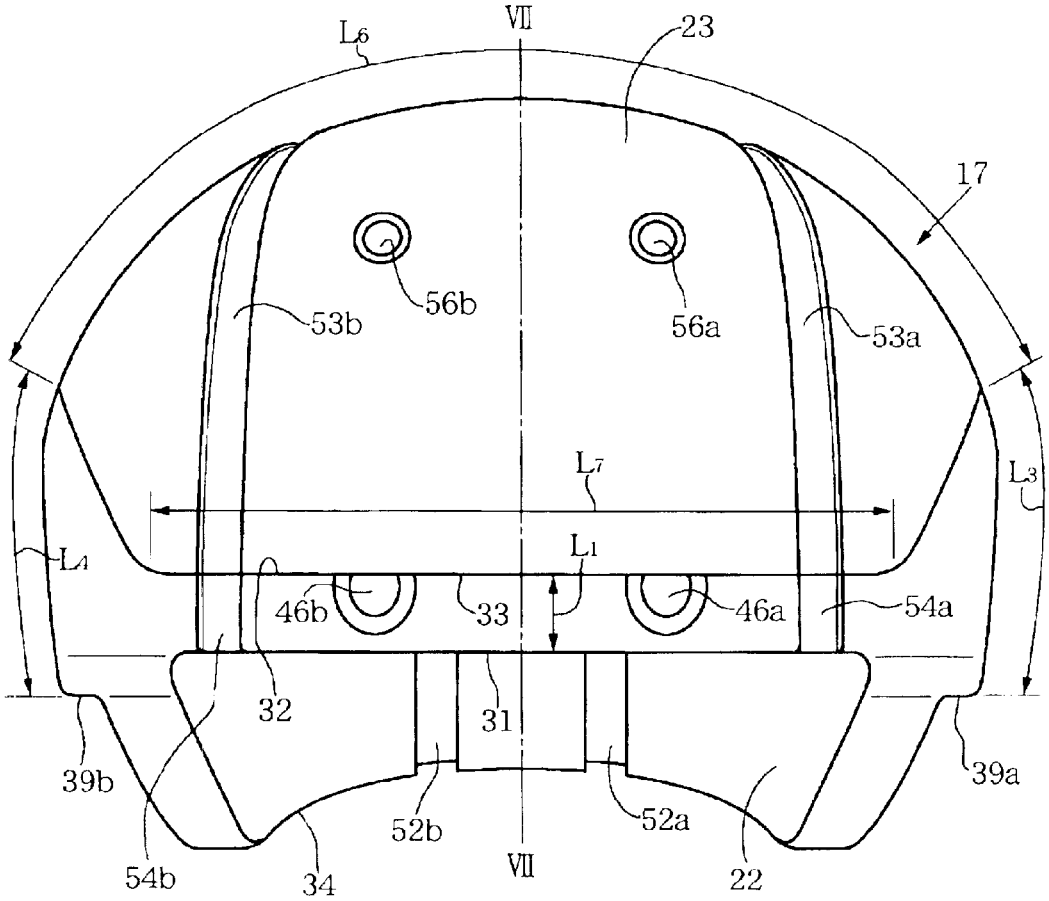
FIG. 3 is a front view of the impact-on-the-head absorbing liner shown in FIG. 1.

As shown FIGS. 1 and 2, a head protecting body 10 serves to form a full-face-type safety helmet. Accordingly, in addition to the head protecting body 10, the helmet has a pair of conventionally known left and right chin straps (not shown), the proximal ends of which are attached to the inner side of the head protecting body 10. As described above, the helmet can further have a conventionally known shield plate 11 for opening/closing a window opening 9. FIGS. 1 and 2 show the head protecting body 10 in a state wherein the wearer wearing the helmet is in an ordinary posture.

As shown in FIGS. 1 and 2, the head protecting body 10 is made up from a full-face-type outer shell 12 which constitutes the circumferential wall of the head protecting body 10, a lower rim member 13 and rim member 14 for the window opening 9 that are conventionally known, a backing member 15 for the head which is attached to the outer shell 12 by adhesion or the like in contact with the inner surface of the outer shell 12, and a backing member 16 for the chin and cheeks.

The characteristic feature of this invention resides in the structure of an impact-on-the-head absorbing liner 17 which constitutes the backing member 15 for the head. Except for this, the structure of this invention can be the same as the conventionally known one as described above. Hence, the description of the structure of the above arrangement and the like will be omitted when necessary.

The outer shell 12 must have a high rigidity and high breaking strength so that when an impact is applied to the region of part of the outer shell 12, the outer shell 12 can disperse the impact over its wide region and can absorb the impact energy by its deformation. Therefore, the outer shell 12 can be made of a rigid reinforced resin obtained by mixing a reinforcement such as glass fiber, carbon fiber or organic high-strength fiber with a thermoset resin such as an unsaturated polyester resin or epoxy resin and hardening the mixture, or of a rigid reinforced resin obtained by mixing the reinforcement in a thermoplastic resin such as polycarbonate and molding the mixture with heat. Alternatively, the outer shell 12 can be made of a composite material obtained by backing the inner surface of the rigid reinforced resin with a flexible sheet such as an unwoven fabric. The average thickness of the outer shell 12 preferably falls within a range of 1 mm to 6 mm, and more preferably falls within a range of 2 mm to 5 mm. The smaller the thickness of the outer shell 12 than the lower limit of the above range, the lower the rigidity. The larger the thickness of the outer shell 12 than the upper limit of the above range, the heavier. Neither one is preferable very much.

The backing member 15 for the head may have a shape to come into contact with substantially the entire inner surface of the outer shell 12. Alternatively, as shown in FIGS. 1 and 2, the backing member 16 for the chin and cheeks may be formed separately. In the latter case, the backing member 15 for the head is notched in those portions of inner surface of the outer shell 12 which correspond to the chin and cheeks of the wearer. The backing member 15 for the head shown in FIGS. 1 and 2 is constituted by the impact-on-the-head absorbing liner 17 having a shape notched in those portions of the inner surface of the outer shell 12 which correspond to the chin and cheeks of the wearer, and an air-permeable backing cover for the head (not shown) which covers the liner 17 from its inner surface side.

As shown in FIGS. 1 and 2, the backing member 16 for the chin and cheeks is constituted by an impact-on-the-chin-and-cheeks absorbing liner 18, an air permeable backing cover for the chin and cheeks (not shown) covering the impact-on-the-chin-and-cheeks absorbing liner 18 from its inner surface side and left and right blockish inner pads (neither is shown) each arranged on the inner surface of the impact-on-the-chin-and-cheeks absorbing liner 18 through the backing cover for the chin and cheeks and made of a flexible elastic material such as urethane foam or another synthetic resin. The pair of left and right chin straps (not shown) described above are attached to the inner surface of the outer shell 12 by riveting or the like, and extend to a head accommodating space 20 through a pair of left and right openings 19 formed in the backing member 16 for the chin and cheeks.

The impact-on-the-head absorbing liner 17 must have an appropriate plastic deformation rate and an appropriate elastic deformation rate so that it can absorb the impact energy propagating from the outer shell 12 with the deformation of its outer shape, can absorb the impact energy by decreasing its thickness, and can delay propagation of the impact energy to the head of the wearer.

The head protecting body 10 has five regions (in other words, a sinciput region (i.e., a forehead region), a vertex region, left and right temple regions (i.e., left and right temple regions) and an occiput region) respectively opposing five portions formed of the sinciput part (in other words, the forehead part), the vertex part, the left and right temple parts and an occiput part of the head of the wearer. The vertex region of the head protecting body 10 is continuous to the sinciput region (in other words, the forehead region), the left and right temple regions and the occiput region and is substantially hemispherical. Thus, in the conventional safety helmet described above, the vertex region has the largest strength among the five regions. The occiput region of the head protecting body 10 extends long downward and is continuous to the vertex region and the left and right temple regions in any one of the full-face-, jet- and semi-jet-type helmets, and accordingly has the second largest strength. The sinciput region (i.e., the forehead region) of the head protecting body 10 has the window opening 9 or a notch, as described above, and generally has a ventilator mechanism for ventilation, so that it has the smallest strength. The left and right temple regions of the head protecting body 10 are adjacent to the window opening 9 or the notch, so that they have strengths larger than that of the sinciput region (forehead region) but considerably smaller than that of the occiput region.

As described above, in the conventional helmet, as the vertex region of the head protecting body 10 has the largest strength and is substantially hemispherical, the outer shape of the vertex region of the impact-on-the-head absorbing liner 17 does not effectively deform by the impact energy propagating from the outer shell 12 to the liner 17. Hence, even when impact tests are performed under the same conditions, the maximum acceleration of the vertex region and the HIC tend to increase more than those of the other regions (the forehead region, the left and right temple regions and the occiput region) of the head protecting body 10. In order to efficiently disperse and absorb the impact energy acting on the head protecting body 10 so that the maximum acceleration and the HIC are decreased, in the vertex region of the head protecting body 10, the impact-on-the-head absorbing liner 17 must effectively deform its outer shape by the impact so that it disperses and absorbs the impact energy effectively, and must effectively decrease its thickness so that it can absorb the impact energy effectively.

(2) Impact-on-the-Head Absorbing Liner

In view of the above requirements, according to the first embodiment of this invention, as shown in FIGS. 1 to 14, in the same manner as in the antecedent head protecting body, the impact-on-the-head absorbing liner 17 is constituted by ① a main liner member (in other words, first liner member) 22 having a shape obtained by forming an outer recess (in other words, a surface recess) 21 in the outer surface of the conventionally known impact-on-the-head absorbing liner, and ② an outer auxiliary liner member (in other words, second liner member) 23 attached to the main liner member 22 so as to fit in the outer recess 21.

Figure 7:
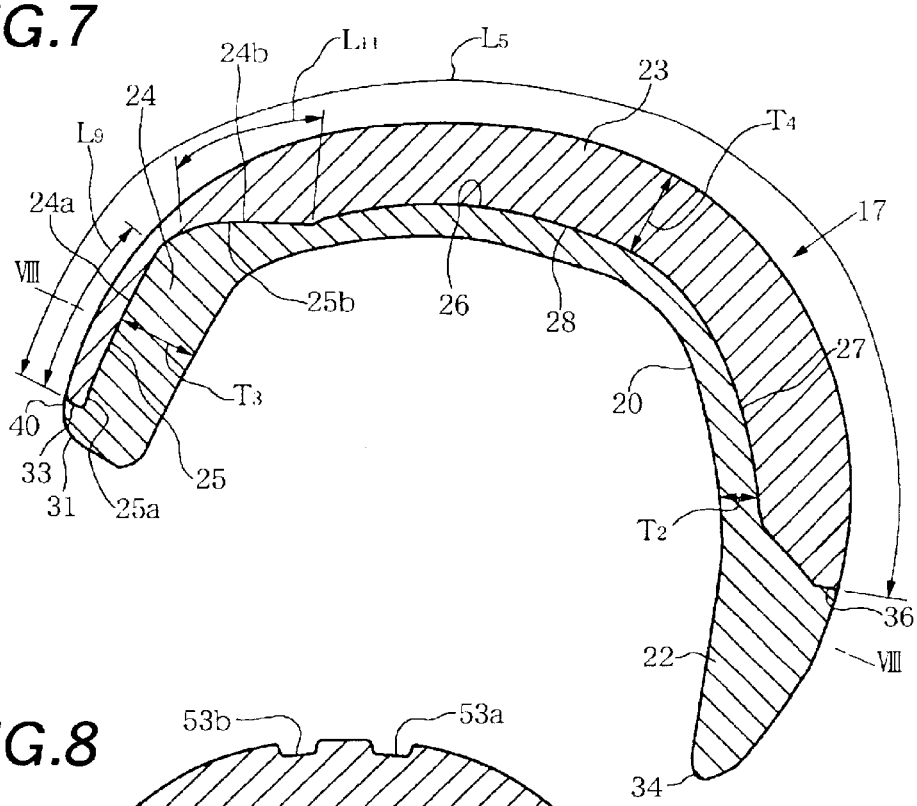
FIG. 7 is a sectional view taken along the line VII—VII of FIG. 3.
Figure 8:
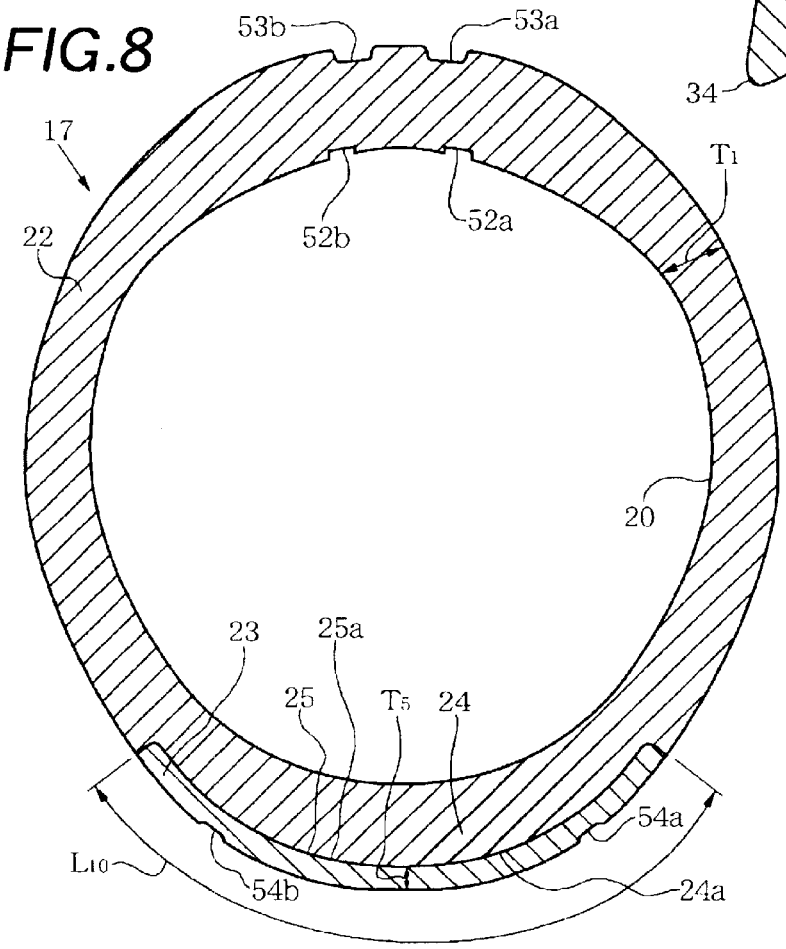
FIG. 8 is a sectional view taken along the line VIII—VIII of FIG. 7.
Figure 9:
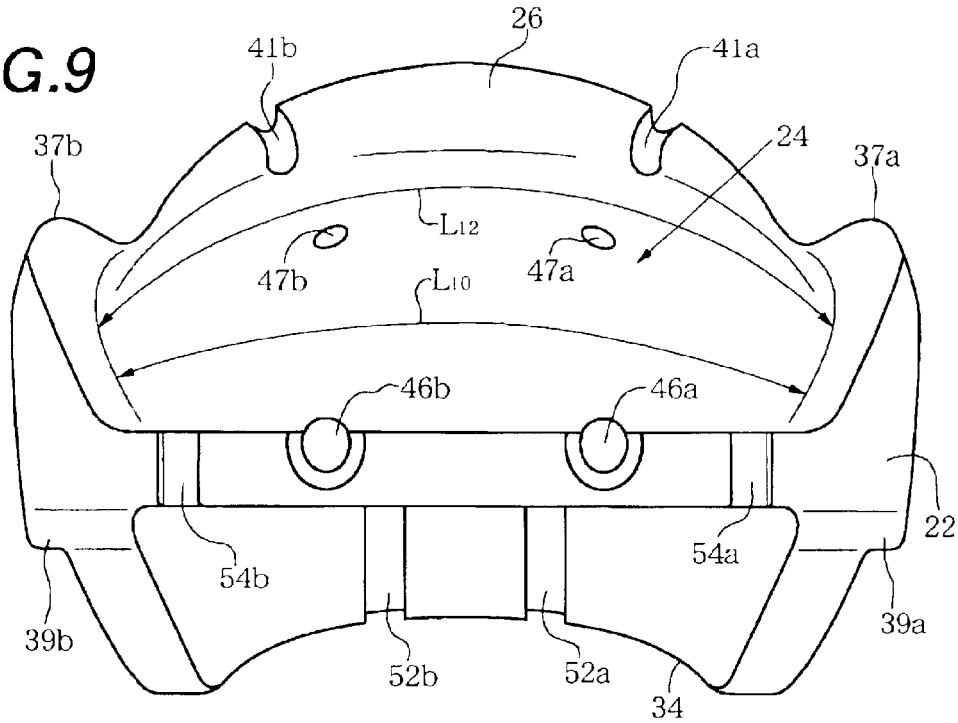
FIG. 9 is a front view of the main liner member shown in FIG. 3.
Figure 10:
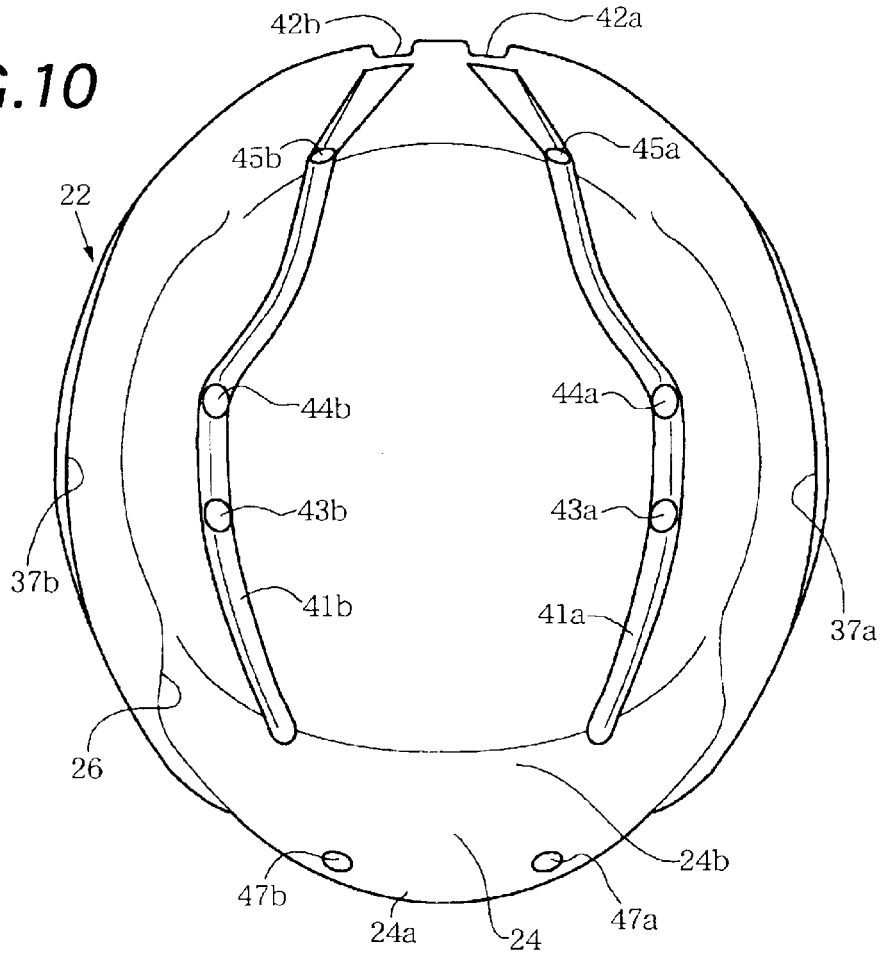
FIG. 10 is a plan view of the main liner member shown in FIG. 9.
Figure 12:
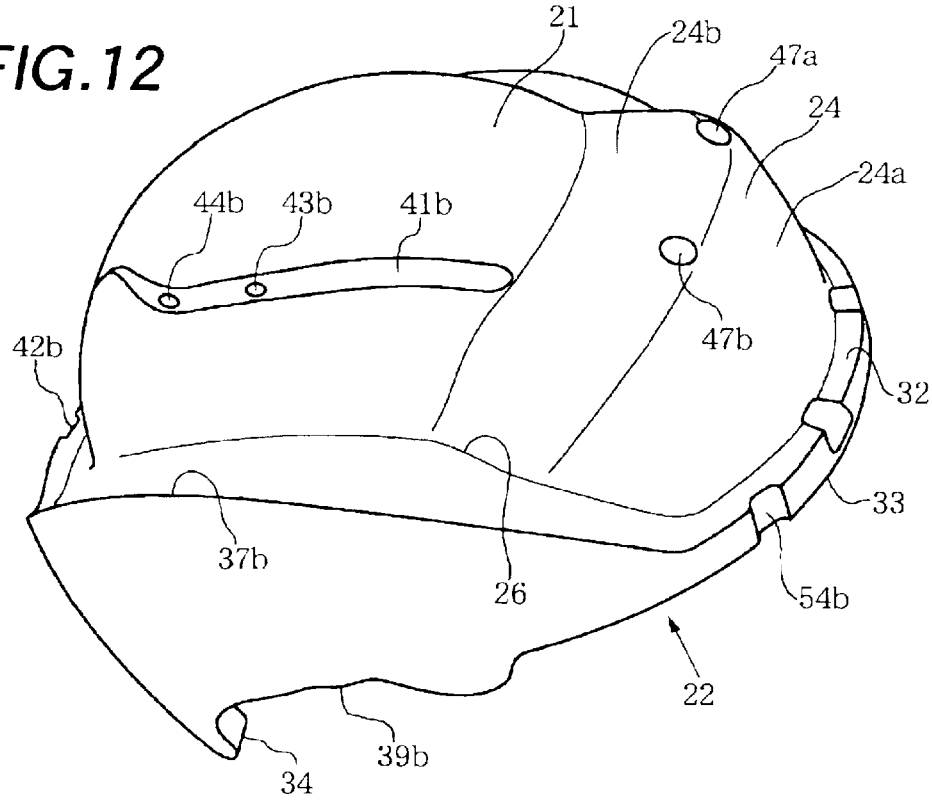
FIG. 12 is a perspective view, seen from obliquely ahead of the upper right, of the main liner member shown in FIG. 9.
Figure 13:
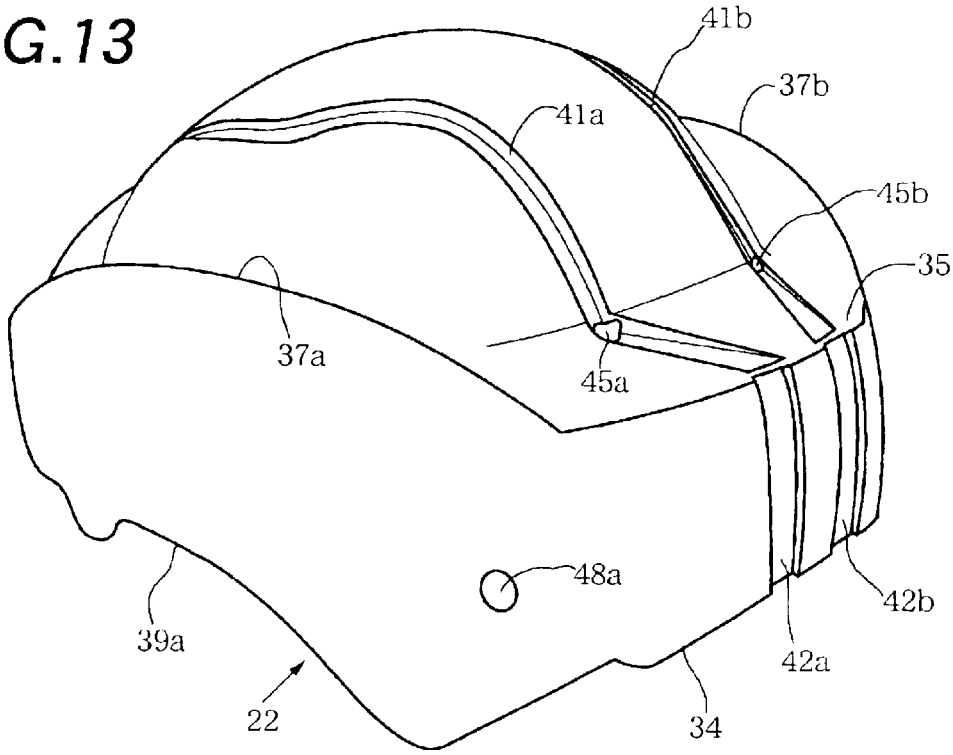
FIG. 13 is a perspective view, seen from obliquely behind the upper left, of the main liner member shown in FIG. 9.

According to the first embodiment of this invention, different from the antecedent head protecting body, as shown in FIGS. 7, 8, 12 and the like, the main liner member 22 has a swell 24 near the forehead region of a bottom surface 26 of the outer recess 21, and the outer auxiliary liner member 23 has a hollow 25 in its inner surface to oppose the swell 24. The swell 24 (particularly a tableland 24*a* to be described later) may be formed in the same manner as the hollow 25 (particularly a lowland 25*a* to be described later), such that a forehead region is included, at least partly, in a region formed of the forehead region (and, depending on the case, the front half of the vertex region), and its vicinity.

The outer recess 21 of the main liner member 22 and the outer auxiliary liner member 23 may have almost the same shapes. As each of the main liner member 22 and outer auxiliary liner member 23 must have an appropriate plastic deformation rate and appropriate elastic deformation rate, it is preferably formed of a foamed body of a synthetic resin such as polystyrene, polypropylene or polyethylene. Although the main liner member 22 and outer auxiliary liner member 23 are preferably made of the same type of material, they may be made of different types of materials. In such a foamed body, its density (g/liter) is generally substantially proportional to its compression strength (kg/cm$^2$) and bending strength (kg/cm$^2$). Hence, the absorbing ability and propagating ability of the impact energy differ depending on the density. According to the present invention, the outer auxiliary liner member 23 must have a smaller compression strength and smaller bending strength as compared to the main liner member 22. Hence, the density of the outer auxiliary liner member 23 is smaller than that of the main liner member 22, as will be described later. In the first embodiment, the outer recess 21 and outer auxiliary liner member 23 are provided for improving dispersion and absorption of the impact energy by means of the outer auxiliary liner member 23 and making it easy to provide a ventilator mechanism to the head protecting body 10. To satisfy these objects, the main liner member 22 has the outer recess 21 (in other words, the outer auxiliary liner member 23) extending from its forehead region to its occiput region through its vertex region.

As shown in FIGS. 3 to 8, the outer recess 21 (in other words, the outer auxiliary liner member 23) can have a substantially spherical surface's shape ("spherical surface" here means the partial shape of the surface of a spheroidal) that can be developed into a shape which is somewhat long in the back-and-forth direction and substantially similar to a rectangle. More specifically, the shape obtained by developing the outer recess 21 and outer auxiliary liner member 23 can have a substantially rectangular shape with its left and right sides projecting arcuately rightward and leftward.

As shown in FIGS. 3 to 7, the outer recess 21 and outer auxiliary liner member 23 can respectively have positions slightly above a lower end 31 of the forehead region of the main liner member 22 as their front ends 32 and 33, and positions above a lower end 34 of the occiput region of the main liner member 22 by a certain degree (that is, intermediate positions in the vertical direction of the occiput region, or positions slightly above the intermediate positions with heights substantially corresponding to the lower end 31 of the forehead region of the main liner member 22) as their rear ends 35 and 36. The front ends 32 and 33 and the rear ends 35 and 36 can extend substantially horizontally in the left-to-right direction. Furthermore, the outer recess 21 and outer auxiliary liner member 23 can respectively have portions near the boundary of the vertex region and left temple region (that is, the left-side temple region) of the main liner member 22 as their left side ends 37*a* and 38*a*, and portions near the boundary of the vertex region and right temple region (that is, the right-side temple region) of the main liner member 22 as their right side ends 37*b* and 38*b*. The front end 32 of the outer recess 21 and the front end 33 of the outer auxiliary liner member 23 may be set to coincide with the lower end 31 of the forehead region of the main liner member 22, so that a projecting ridge 40 extending in substantially the left-to-right direction of the main liner member 22 between the lower end 31 and the front ends 32 and 33 can be eliminated.

Figure 4:
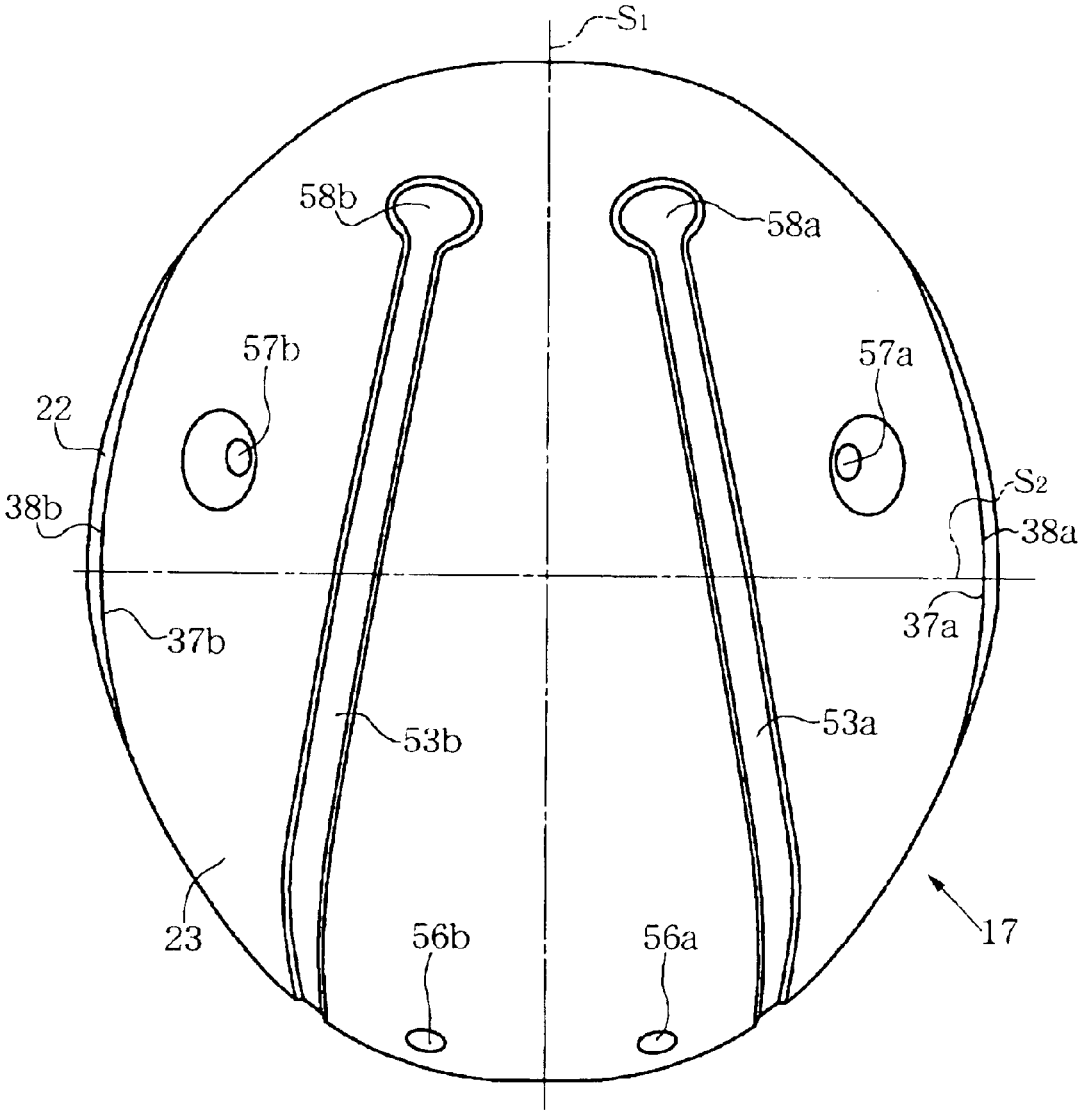
FIG. 4 is a plan view of the impact-on-the-head absorbing liner shown in FIG. 3.
Figure 5:
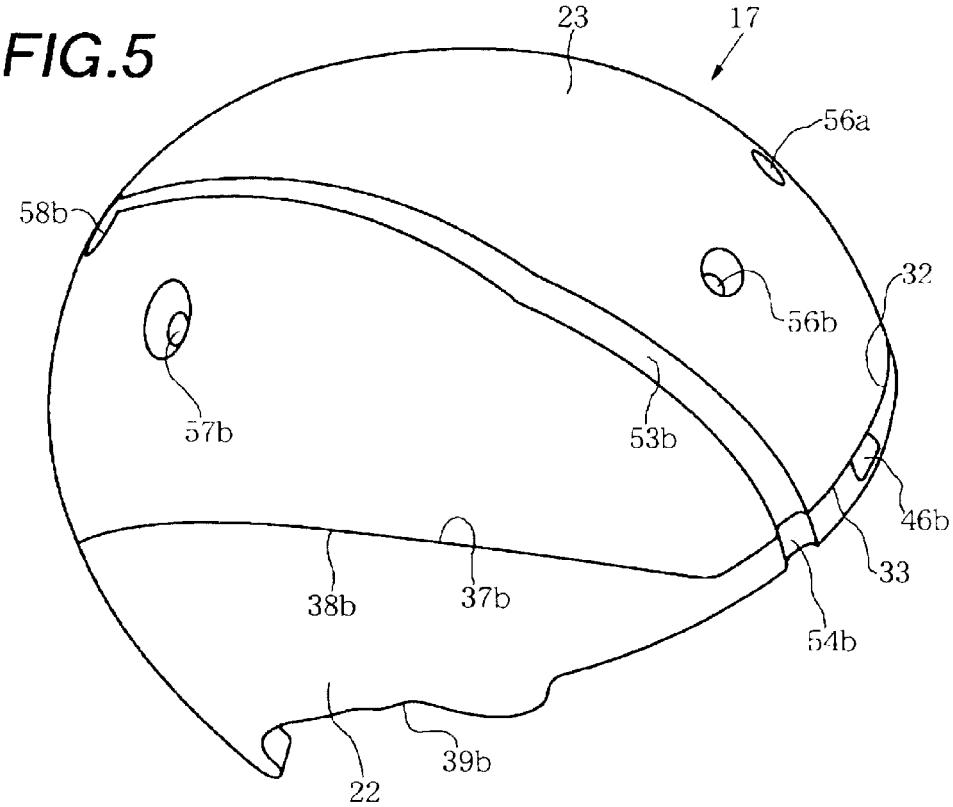
FIG. 5 is a perspective view, seen from obliquely ahead of the upper right, of the impact-on-the-head absorbing liner shown in FIG. 3.
Figure 6:
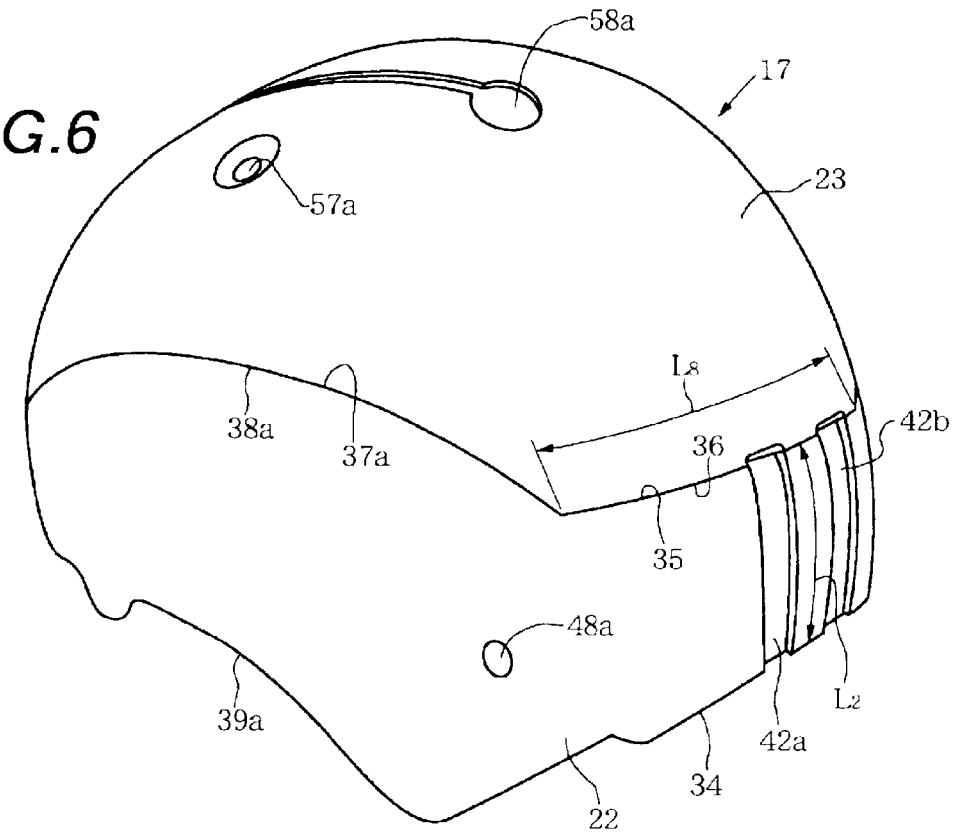
FIG. 6 is a perspective view, seen from obliquely behind the upper left, of the impact-on-the-head absorbing liner shown in FIG. 3.

FIG. 4 shows a central plane $S_1$ in the left-to-right direction of the impact-on-the-head absorbing liner 17. As FIG. 4 is a plan view, in FIG. 4, the central plane $S_1$ is indicated as a central line extending in the vertical direction. When a section along the central plane $S_1$ will be considered, a development length (that is, the length of the envelope line; this applies to the following description) $L_1$ (see FIG. 3) between the lower end 31 of the forehead region of the main liner member 22 and the front end 32 of the outer recess 21 (in other words, the front end 33 of the outer auxiliary liner member 23) is about 1.5 cm in the embodiment shown in FIG. 3, but generally preferably falls within a range of 0.5 cm to 4.5 cm from the viewpoint of practicality. The development length $L_1$ further preferably falls within a range of 1 cm to 3 cm, and may be substantially zero depending on the case. In the section along the central plane $S_1$, a development length $L_2$ (see FIG. 6) between the lower end 34 of the occiput region of the main liner member 22 and the rear end 35 of the outer recess 21 (in other words, the rear end 36 of the outer auxiliary liner member 23) is about 5.5 cm in the embodiment shown in FIG. 6, but generally preferably falls within a range of 1 cm to 12 cm from the viewpoint of practicality. The development length $L_2$ further preferably falls within a range of 2.5 cm to 8 cm, and may be substantially zero depending on the case.

The preferable numerical value range and the further preferable numerical value range of the average development length between the lower end 31 of the forehead region of the main liner member 22 and the front end 33 of the outer auxiliary liner member 23 can be substantially identical to the preferable numerical value range and the further preferable numerical value range described above of the development length $L_1$. The average development length between the lower end 34 of the occiput region of the main liner member 22 and the rear end 36 of the outer auxiliary liner member 23 can be substantially identical to the preferable numerical value range and the further preferable numerical value range described above of the development length $L_2$.

FIG. 4 also shows a central plane $S_2$ in the back-and-forth direction of the impact-on-the-head absorbing liner 17. As FIG. 4 is a plan view, in FIG. 4, the central plane $S_2$ is indicated as a central line extending in the left-to-right direction. When a section along the central plane $S_2$ will be considered, a development length $L_3$ (see FIG. 3) between a lower end 39*a* of the left temple region of the main liner member 22 and the left side end 37*a* of the outer recess 21 (in other words, the left side end 38*a* of the outer auxiliary liner member 23), and a development length $L_4$ (see FIG. 3) between a lower end 39*b* of the right temple region of the main liner member 22 and the right side end 37*b* of the outer recess 21 (in other words, the right side end 38*b* of the outer auxiliary liner member 23) are about 10 cm in the embodiment shown in FIG. 3, but generally preferably fall within a range of 4 cm to 18 cm from the viewpoint of practicality, and further preferably fall within a range of 6 cm to 15 cm.

In the section along the central plane $S_1$ shown in FIG. 4, a development length $L_5$ (see FIG. 7) of the open surface of the outer recess 21 (in other words, the outer surface of the outer auxiliary liner member 23) is about 45 cm in the embodiment shown in FIG. 7, but generally preferably falls within a range of 20 cm to 55 cm from the viewpoint of practicality, and is further preferably within a range of 30 cm to 50 cm. A development length $L_6$ (see FIG. 3) of the open surface of the outer recess 21 (in other words, the outer surface of the outer auxiliary liner member 23) along the central line $S_2$ shown in FIG. 4 is about 30 cm in the embodiment shown in FIG. 3, but generally preferably falls within a range of 15 cm to 50 cm from the viewpoint of practicality, and further preferably falls within a range of 20 cm to 40 cm. Development lengths $L_7$ and $L_8$ (see FIGS. 3 and 6) in the left-to-right direction of the front end and rear end of the outer recess 21 (in other words, the outer auxiliary liner member 23) are respectively about 16.5 cm and about 15 cm in the embodiment shown in FIGS. 3 and 6, but generally preferably fall within a range of 8 cm to 26 cm from the viewpoint of practicality, and further preferably fall within a range of 12 cm to 22 cm.

Of the bottom surface of the outer recess 21 formed in the main liner member 22, a portion near the forehead region has the swell 24 rising outward. In other words, the main liner member 22 projects outward to be thick in, of a region having the outer recess 21 (that is, the region of the bottom surface 26), a region where the swell 24 is formed. The swell 24 serves to reinforce the forehead region of the main liner member 22 (and accordingly the impact-on-the-head absorbing liner 17). As shown in FIGS. 7, 12 and the like, the forehead region reinforcing swell 24 is constituted by the tableland 24*a* with a substantial trapezoidal shape or the like extending from the front end 32 of the outer recess 21 obliquely upward and having a substantially constant thickness, and an inclined portion (i.e., thickness transient region) 24*b* with substantially backward and rectangular shape or the like, having a thickness gradually decreasing from the tableland 24*a* substantially backward and continuous to a portion of the bottom surface 26 which excludes the swell 24 (i.e., a non-swelling region 27). The hollow 25 formed in the inner surface of the outer auxiliary liner member 23 to oppose the swell 24 can have a shape substantially coinciding with the swell 24 (in other words, can have substantially the same shape), as shown in FIGS. 7 and 8. Thus, the hollow 25 has the lowland 25*a* and an inclined portion (i.e., thickness transient region) 25*b* having shapes respectively corresponding to the tableland 24*a* and inclined portion 24*b* of the swell 24. To fit the outer auxiliary liner member 23 in the outer recess 21 of the main liner member 22, as shown in FIGS. 7 and 8, the outer auxiliary liner member 23 may be placed in the outer recess 21 from the outer surface side of the main liner member 22 and be fitted in the outer recess 21. In this case, the outer auxiliary liner member 23 and outer recess 21 may be adhered or taped with each other when necessary.

An average development length $L_9$ (see FIG. 7) in the back-and-forth direction of the tableland 24*a* (in other words, the lowland 25*a*) is about 6 cm in the embodiment shown in FIG. 7, but generally preferably falls within a range of 2.5 cm to 12 cm from the viewpoint of practicality, and further preferably falls within a range of 4 cm to 9 cm. An average development length $L_{10}$ (see FIG. 8) in the left-to-right direction of the tableland 24*a* (in other words, the lowland 25*a*) is about 19 cm in the embodiment shown in FIG. 8, but generally preferably falls within a range of 9 cm to 28 cm from the viewpoint of practicality, and further preferably falls within a range of 13 cm to 24 cm. A development area ($L_9 \times L_{10}$) of the tableland 24*a* (in other words, the lowland 25*a*) is about 114 $cm^2$ in the embodiment shown in FIGS. 7 and 8, but generally preferably falls within a range of 50 $cm^2$ to 220 $cm^2$ from the viewpoint of practicality, and further preferably falls within a range of 75 $cm^2$ to 160 $cm^2$.

An average development length $L_{11}$ (see FIG. 7) in the back-and-forth direction of the inclined portion 24*b* (in other words, the inclined portion 25*b*) is about 3 cm in the embodiment shown in FIG. 7, but generally preferably falls within a range of 1 cm to 6 cm from the viewpoint of practicality, and further preferably falls within a range of 2 cm to 4.5 cm. An average development length $L_{12}$ (see FIG. 9) in the left-to-right direction of the inclined portion 24*b* (in other words, the inclined portion 25*b*) is about 22 cm in the embodiment shown in FIG. 9, but generally preferably falls within a range of 11 cm to 32 cm from the viewpoint of practicality, and is further preferably within a range of 15 cm to 28 cm. A development area ($L_{11} \times L_{12}$) the of inclined portion 24*b* (in other words, the inclined portion 25*b*) is about 66 $cm^2$ in the embodiment shown in FIGS. 7 and 9, but generally preferably falls within a range of 25 $cm^2$ to 140 $cm^2$ from the viewpoint of practicality, and further preferably falls within a range of 35 $cm^2$ to 100 $cm^2$. The ratio of the development area ($L_{11} \times L_{12}$) of the inclined portion 24*b* (in other words, the inclined portion 25*b*) to the development area ($L_9 \times L_{10}$) of the tableland 24*a* (in other words, the lowland 25*a*) is about 0.58 in the embodiment shown in FIGS. 7 to 9, but generally preferably falls in the range of 0.25 to 1.2 from the viewpoint of practicality, and further preferably falls within a range of 0.35 to 0.9.

The development area of that portion 27 of the bottom surface 26 of the outer recess 21 of the main liner member 22 which excludes the swell 24 (i.e., non-swelling region), and the development area of that portion 28 of the inner surface of the outer auxiliary liner member 23 which excludes the hollow 25 (i.e., non-hollow region) are about 515 $cm^2$ in the embodiment shown in FIG. 7, but generally preferably fall within a range of 250 $cm^2$ to 1,000 $cm^2$ from the viewpoint of practicality, and further preferably fall within a range of 400 $cm^2$ to 800 $cm^2$. The ratio of the development area ($L_9 \times L_{10} + L_{11} \times L_{12}$) of the swell 24 (in the other words, the hollow 25) to the development area of the non-swelling region 27 of the bottom surface 26 of the outer recess 21 of the main liner member 22 (in other words, a non-hollow region 28 of the outer auxiliary liner member 23) is about 0.26 in the embodiment shown in FIGS. 7 to 9, but generally preferably falls within a range of 0.1 to 0.6 from the viewpoint of practicality, and further preferably falls within a range of 0.15 to 0.45. The ratio of the development area ($L_9 \times L_{10}$) of the tableland 24*a* (in other words, the lowland 25*a*) to the development area of the non-swelling region 27 of the bottom surface 26 of the outer recess 21 of the main liner member 22 (in other words, the non-hollow region 28 of the outer auxiliary liner member 23) is about 0.16 in the embodiment shown in FIGS. 7 to 9, but generally preferably falls within a range of 0.06 to 0.5 from the viewpoint of practicality, and further preferably falls within a range of 0.1 to 0.3.

An average thickness $T_1$ (see FIG. 8) of that portion of the main liner member 22 which excludes a portion where the outer recess 21 is formed is about 4 cm in the embodiment shown in FIG. 8, but generally preferably falls within a range of 1.5 cm to 8 cm from the viewpoint of practicality, and further preferably falls within a range of 2.5 cm to 6 cm. An average thickness $T_2$ (see FIG. 7) of the non-swelling region 27 of the outer recess 21 of the main liner member 22 is about 1.5 cm in the embodiment shown in FIG. 7, but generally preferably falls within a range of 0.5 cm to 3 cm from the viewpoint of practicality, and further preferably falls within a range of 0.8 cm to 2.4 cm. An average thickness $T_3$ (see FIG. 7) of the tableland 24*a* of the main liner member 22 is about 3 cm in the embodiment shown in FIG. 7, but generally preferably falls within a range of 1 cm to 6 cm from the viewpoint of practicality, and further preferably falls within a range of 1.5 cm to 4.5 cm. The inclined portion 24*b* of the main liner member 22 preferably has a thickness that gradually decreases from the tableland 24*a* backward. However, the inclined portion 24*b* need not be particularly formed in this manner, but may be a thickness transient region having another arrangement.

An average thickness $T_4$ (see FIG. 7) of the non-hollow region 28 of the outer auxiliary liner member 23 is about 2.5 cm in the embodiment shown in FIG. 7, in the same manner as the depth of the non-swelling region 27 of the outer recess 21 of the main liner member 22, but generally preferably falls within a range of 0.8 cm to 5 cm from the viewpoint of practicality, and further preferably falls within a range of 1.4 cm to 4 cm. An average thickness $T_5$ (see FIG. 8) of the lowland 25*a* of the outer auxiliary liner member 23 is about 1 cm in the embodiment shown in FIG. 8, but generally preferably falls within a range of 0.3 cm to 2 cm from the viewpoint of practicality, and further preferably falls within a range of 0.5 cm to 1.5 cm. The inclined portion 25*b* of the outer auxiliary liner member 23 preferably has a thickness that gradually decreases from the lowland 25*a* backward. However, the inclined portion 25*b* need not be particularly formed in this manner, but may be a thickness transient region having another arrangement.

The ratio ($T_5/T_3$) of the average thickness $T_5$ of the lowland 25*a* to the average thickness $T_3$ of the tableland 24*a* is about ⅓ in the embodiment shown in FIGS. 7 and 8, but generally preferably falls within a range of 1/12 to 5/6 from the viewpoint of practicality, and further preferably falls within a range of ⅙ to ⅔. The ratio ($T_4/T_2$) of the average thickness $T_4$ of the non-hollow region 28 of the outer auxiliary liner member 23 to the average thickness $T_2$ of the non-swelling region 27 of that portion of the main liner member 22 where the outer recess 21 is formed is about ⅝ in the embodiment shown in FIG. 7, but generally preferably falls within a range of ½ to 4 from the viewpoint of practicality, and further preferably falls within a range of 1 to 3. Similarly, the ratio ($T_3/T_2$) is about 2 in the embodiment shown in FIG. 7, but generally preferably falls within a range of 1.2 to 4 from the viewpoint of practicality, and further preferably falls within a range of 1.5 to 3. The ratio ($T_5/T_4$) is about ⅖ in the embodiment shown in FIGS. 7 and 8, but generally preferably falls within a range of ⅕ to ⅘ from the viewpoint of practicality, and further preferably falls within a range of 3/10 to 3/5. The ratio ($T_3/T_1$) is about 3/5 in the embodiment shown in FIGS. 7 and 8, but generally preferably falls within a range of 1/2 to 7/8 from the viewpoint of practicality, and further preferably falls within a range of 2/3 to 5/6.

The developed shape of each of the outer recess 21 and outer auxiliary liner member 23 may be a substantially rectangular shape which is long in the back-and-forth direction, a shape in which the left and right sides of this substantially rectangular shape respectively project arcuately outward to the left and right, a substantially oval shape, or any other elliptic shape, a substantially oval shape, or any other arbitrary shape. The density of the main liner member 22 is about 45 g/liter in the embodiment shown in FIGS. 1 to 14, but generally preferably falls within a range of 20 g/liter to 70 g/liter from the viewpoint of practicality, and further preferably falls within a range of 30 g/liter to 60 g/liter. The larger the density of the main liner member 22 than the upper limit of the above range, the smaller the absorption ability of the main liner member 22 for the impact energy applied to the outer shell 12. Thus, a large portion of the impact energy directly propagates to the head of the wearer. In this case, the maximum acceleration on the head of the wearer increase, and the protection effect by the helmet accordingly becomes insufficient, which is not preferable. The smaller the density of the main liner member 22 than the lower limit of the above range, the larger the absorption ability for the impact energy. In this case, the deformation of the outer shape of the main liner member 22 by the impact is excessively large, and the helmet can be broken too easily, which is not preferable.

The density of the outer auxiliary liner member 23 is about 25 g/liter in the embodiment shown in FIGS. 1 to 14, but generally preferably falls within a range of 5 g/liter to 45 g/liter from the viewpoint of practicality, and further preferably falls within a range of 10 g/liter to 40 g/liter. The larger the density of the outer auxiliary liner member 23 than the upper limit of the above range, the less sufficient the effect obtained by providing the outer auxiliary liner member 23. Also, the smaller the density of the outer auxiliary liner member 23 than the lower limit of the above range, the less the buffer ability. Then, the possibility of causing a bottoming phenomenon when the wearer collides against a spherical or projecting collision object increases.

The percentage of the density of the outer auxiliary liner member 23 to the density of the main liner member 22 is about 55.6% in the embodiment shown in FIGS. 1 to 14, but generally preferably falls within a range of 25% to 85% from the viewpoint of practicality, and further preferably falls within a range of 35% to 75%.

In the head protecting body 10 of the first embodiment having the above arrangement, the outer auxiliary liner member 23 of the impact-on-the-head absorbing liner 17 effectively deforms its outer shape upon application of an impact through substantially its entire forehead region, entire vertex region and upper half of the occiput region, to disperse and absorb the impact energy effectively, and decrease its thickness effectively, so that the impact energy is absorbed effectively. Therefore, the helmet having the head protecting body of the first embodiment can decrease both the maximum acceleration during the impact and the HIC effectively. In addition, the main liner member 22 has the swell 24 for reinforcing the forehead region, and the outer auxiliary liner member 23 has the hollow 25 with a shape substantially corresponding to the swell 24. Thus, the impact-on-the-head absorbing liner 17 can be effectively prevented from being broken easily more than necessary near the forehead region without particularly increasing the thickness of the impact-on-the-head absorbing liner 17 at the forehead region.

(3) Ventilator Mechanism

Figure 11:
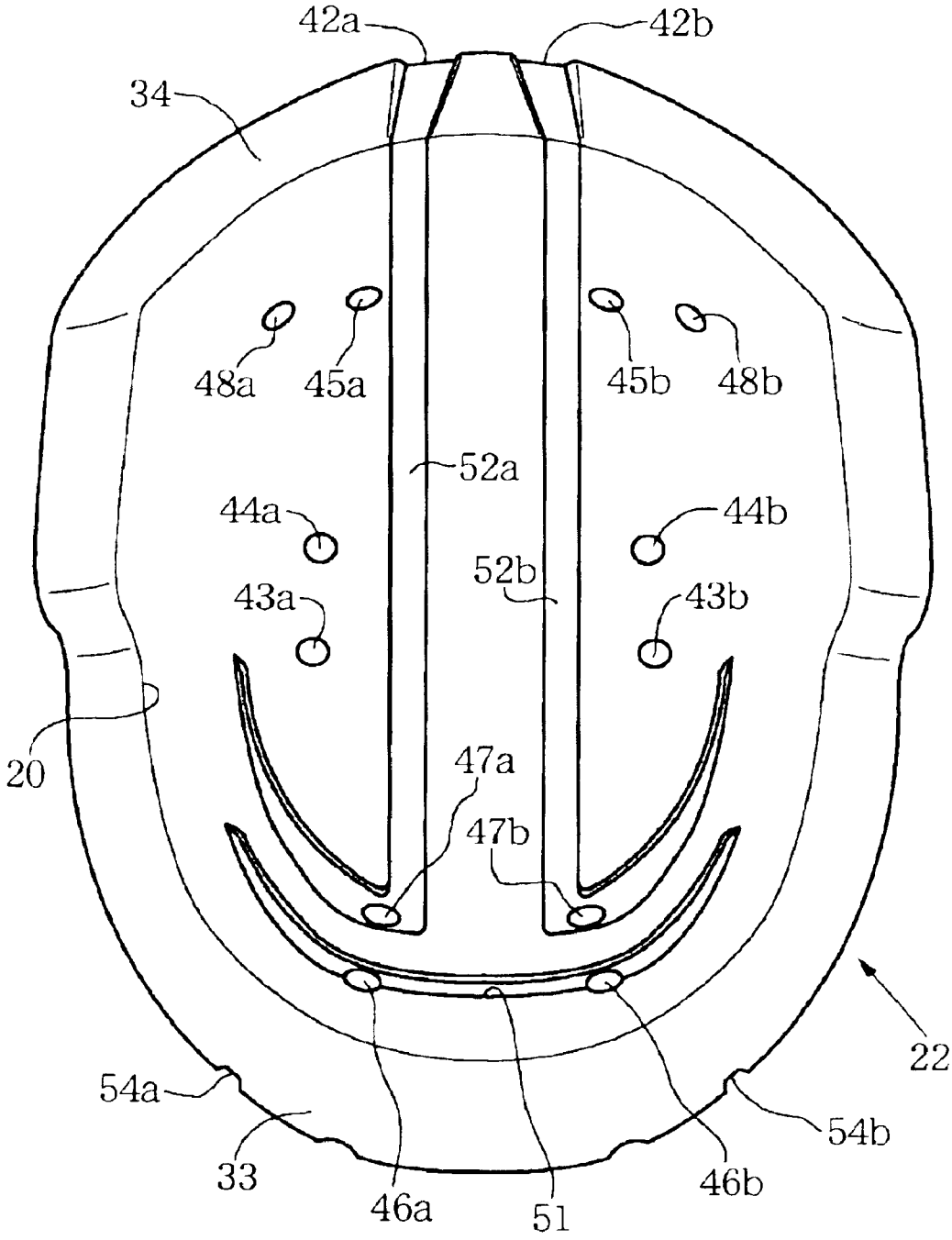
FIG. 11 is a bottom view of the main liner member shown in FIG. 9 and also serves as a bottom view of the impact-on-the-head absorbing liner shown in FIG. 3.

As shown in FIG. 11, the bottom surface 26 of the outer recess 21 of the main liner member 22 has one or a plurality (a pair of left and right in the embodiment shown in FIG. 11; this applies to the following description) of ventilation ridge grooves 41*a* and 41*b* extending from near the rear end of the inclined portion 24*b* to the rear end 35 of the outer recess 21 substantially backward through the vertex region. The ridge grooves 41*a* and 41*b* are continuous to ventilation ridge grooves 42*a* and 42*b* formed in the outer surface of the occiput region of the main liner member 22 to reach its lower end 34. The ridge grooves 41*a* and 41*b* are also continuous to three pairs of left and right through holes 43*a* and 43*b*, 44*a* and 44*b*, and 45*a* and 45*b* extending through the main liner member 22 substantially in the direction of its thickness.

The pair of left and right through holes 43*a* and 43*b* are located slightly ahead of the central plane $S_2$ of the vertex region. The pair of left and right through holes 44*a* and 44*b* are located slightly behind the central plane $S_2$ of the vertex region. The pair of left and right through holes 45*a* and 45*b* are located at the intermediate portion in the back-and-forth direction or at the upper half of the occiput region. Also, a pair of left and right through holes 46*a* and 46*b* are formed between the lower end 31 of the forehead region and the front end 32 of the outer recess 21 of the main liner member 22. A pair of left and right through holes 47*a* and 47*b* are formed, in the swell 24 of the main liner member 22, near the boundary region of the tableland 24*a* and inclined portion 24*b*. A pair of left and right through holes 48*a* and 48*b* are formed near the boundary regions of the occiput region and the left and right temple regions of the main liner member 22.

As shown in FIG. 11, the inner surface of the main liner member 22 has, near substantially the intermediate position in the vertical direction of the forehead region, a ventilation ridge groove 51 extending substantially horizontally in the left-to-right direction and continuous to the pair of left and right through holes 46*a* and 46*b*. The inner surface of the main liner member 22 also has a pair of left and right ventilation ridge grooves 52*a* and 52*b* extending from the pair of left and right through holes 47*a* and 47*b* outward to the left and right substantially horizontally, and from the through holes 47*a* and 47*b* to the lower end 34 through the vertex region and occiput region. The ridge grooves 52*a* and 52*b* are continuous to the pair of left and right ridge grooves 42*a* and 42*b* at the lower end 34.

The outer surface of the outer auxiliary liner member 23 has a pair of left and right ventilation ridge grooves 53*a* and 53*b* extending from its front end 33 to near the rear half of the vertex region (or near the boundary region of the vertex region and occiput region) through the forehead region and vertex region. The ventilation ridge grooves 53*a* and 53*b* are continuous to a pair of left and right ventilation ridge grooves 54*a* and 54*b* extending from the lower end 31 of the forehead region of the main liner member 22 to the front end 32 of the outer recess 21. The inner surface of the outer auxiliary liner member 23 has a pair of left and right ventilation ridge grooves 55*a* and 55*b* to oppose the pair of left and right ridge grooves 41*a* and 41*b* formed in the bottom surface 26 of the outer recess 21 of the main liner member 22. Hence, the ridge grooves 55*a* and 55*b* have their front ends near the boundary region of the lowland 25*a* and inclined portion 25*b*.

Figure 14:
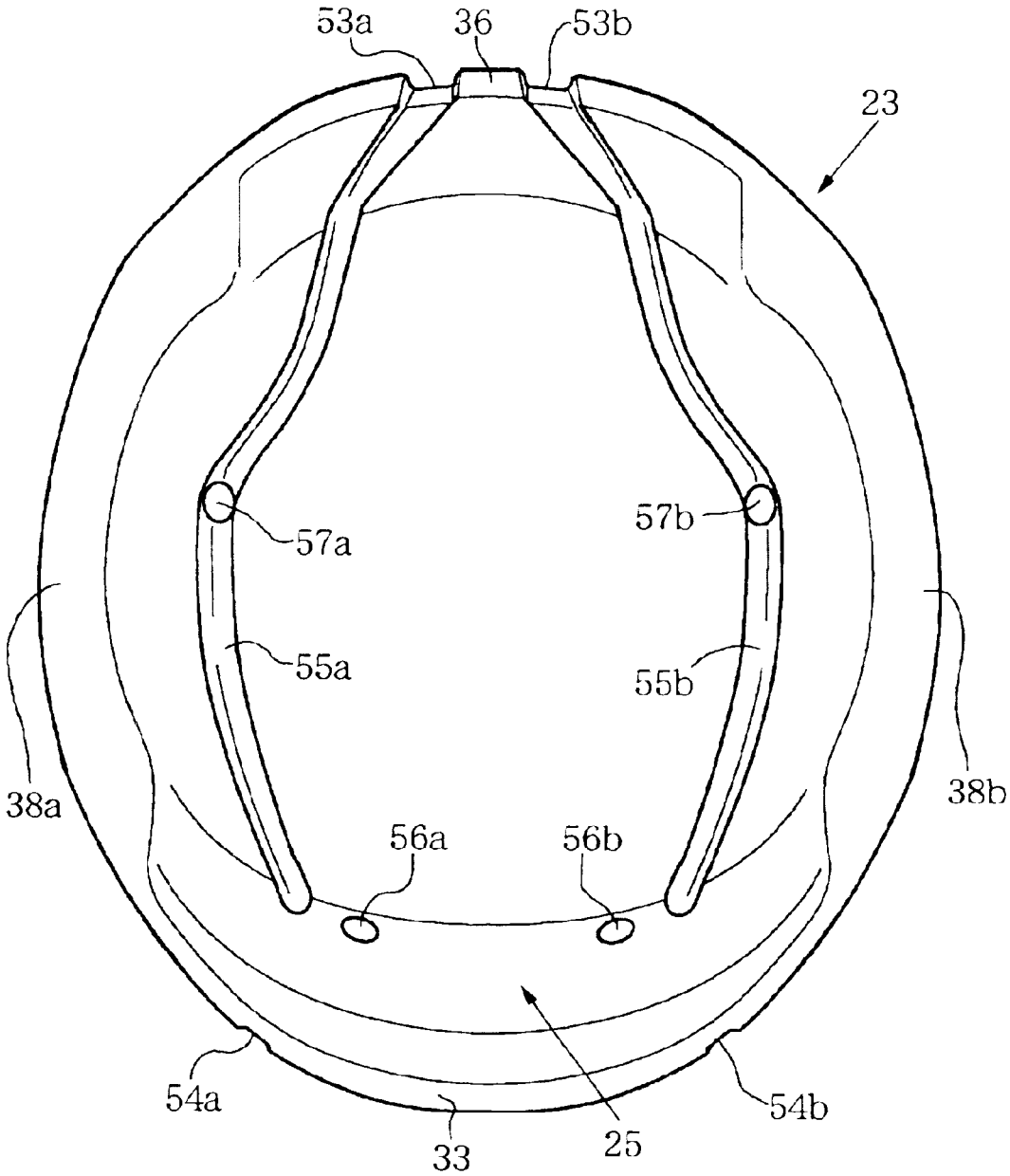
FIG. 14 is a bottom view of the outer auxiliary liner member shown in FIG. 3.

As shown in FIG. 14, the outer auxiliary liner member 23 has a pair of left and right through holes 56*a* and 56*b* to oppose the pair of left and right through holes 47*a* and 47*b* of the main liner member 22. The outer auxiliary liner member 23 has, near substantially the intermediate position (or near a position slightly behind it) in the back-and-forth direction of its vertex region (or near the boundary region of the vertex region and the left and right temple regions), a pair of left and right through holes 57*a* and 57*b* continuous to the pair of left and right ridge grooves 55*a* and 55*b*. The through holes 57*a* and 57*b* respectively oppose the pair of left and right through holes 44*a* and 44*b* of the main liner member 22.

As shown in FIGS. 1 and 2, the outer shell 12 has (i) a chin air supply mechanism 61 formed near the chin region, (ii) a forehead lower portion air supply mechanism 62 formed near the lower portion of the forehead region to be continuous to the through holes 46*a* and 46*b* of the main liner member 22, (iii) a vertex front portion air supply mechanism 63 formed near the front half of the vertex region (or near the boundary region of the forehead region and vertex region) to communicate with the through holes 56*a* and 56*b* of the outer auxiliary liner member 23, (iv) a vertex rear portion exhaust mechanism 64 formed near substantially the intermediate position in the back-and-forth direction of the vertex region or near a position slightly behind it (or near the boundary region of the vertex region and occiput region) to communicate with the through holes 57*a* and 57*b* of the outer auxiliary liner member 23, (v) an occiput front portion exhaust mechanism 65 formed near the rear portion of the vertex region (or near the boundary region of the vertex region and occiput region) to communicate with rear end portions 58*a* and 58*b* of the ridge grooves 53*a* and 53*b* of the outer auxiliary liner member 23, and (vi) a pair of left and right temple portion through holes (not shown) formed near the boundary regions of the left and right temple regions and the occiput region to respectively communicate with the through holes 48*a* and 48*b* of the main liner member 22.

The air supply mechanisms 61, 62 and 63, the exhaust mechanisms 64 and 65 and through holes themselves described in the above items (i) to (vi) can be those that are known conventionally, and a detailed description thereof will be omitted in this specification.

Hence, the head protecting body 10 shown in FIGS. 1 and 2 has (a) a pair of left and right outer surface ventilation holes 71 formed by the inner surface of the outer shell 12 and the ridge grooves 54*a*, 54*b*, 53*a* and 53*b* of the impact-on-the-head absorbing liner 17, (b) a pair of left and right intermediate ventilation holes 72 formed by the ridge grooves 41*a* and 41*b* of the main liner member 22 and the ridge grooves 55*a* and 55*b* of the outer auxiliary liner member 23, and (c) occiput portion ventilation holes 73 formed by the inner surface of the outer shell 12 and the ridge grooves 42*a* and 42*b* of the main liner member 22.

Therefore, in the head protecting body 10 shown in FIGS. 1 and 2, part of the external air introduced into the outer shell 12 through the chin air supply mechanism 61 rises from near the lower end of the shield plate 11 along the inner surface of the shield plate 11 to reach near the upper end of the shield plate 11. The remaining external air is diffused in the head accommodating space 20. The external air that has reached near the upper end of the shield plate 11 and air in the head accommodating space 20 flow through the outer surface ventilation holes 71, advance through the forehead region and vertex region and reach the rear end portions 58*a* and 58*b* of the ridge grooves 53*a* and 53*b*, and are then exhausted to the outside effectively by the exhaust operation of the occiput front portion exhaust mechanism 65 through its exhaust duct.

The external air that has been introduced into the through holes 46*a* and 46*b* from the forehead lower portion air supply mechanism 62 is introduced to the head accommodating space 20 through the through holes 46*a* and 46*b*. Part of the introduced external air flows through the ventilation ridge groove 51 to advance to the left and right sides of the head accommodating space 20. The external air that has been introduced from the vertex front portion air supply mechanism 63 to the through holes 56*a* and 56*b* is introduced to the head accommodating space 20 through the through holes 56*a* and 56*b*, and 47*a* and 47*b*. Part of the introduced external air advances to the left and right sides of the head accommodating space 20 through the ridge grooves 52*a* and 52*b*, and advances to the rear portion of the head accommodating space 20. Part of the external air that has advanced to the rear portion is exhausted to the outside from the lower end 34 of the occiput region.

Air in the head accommodating space 20 is introduced to the four pairs of left and right through holes 43*a* and 43*b*, 44*a* and 44*b*, 45*a* and 45*b* and 48*a* and 48*b*. The air that has been introduced to the through holes 43*a* and 43*b* advances backward through the pair of left and right intermediate ventilation holes 72. Part of the air that has advanced backward, and part of the air that has been introduced from the head accommodating space 20 into the through holes 44*a* and 44*b* advance through the through holes 57*a* and 57*b* by the exhaust operation of the vertex rear portion exhaust mechanism 64, and are exhausted to the outside from the exhaust duct of the vertex rear portion exhaust mechanism 64. The remaining air advances further backward through the intermediate ventilation holes 72. The air advancing backward and the air introduced from the head accommodating space 20 into the through holes 45*a* and 45*b* advance through the intermediate ventilation holes 72 further backward, flow into the occiput portion ventilation holes 73, and are then exhausted to the outside from the lower end 34 of the occiput region. The air that has been introduced to the through holes 48*a* and 48*b* is exhausted to the outside from the lower end 34 of the occiput region through the occiput portion ventilation holes 73 of the outer shell 12. Of the pair of left and right intermediate ventilation holes 72, those portions which are in front of the through holes 43*a* and 43*b* substantially have nothing to do with the air flow. These portions, however, help the main liner member 22 and outer auxiliary liner member 23, even if a little, deform their outer shapes near the front half of their vertex region (or near the boundary region of the forehead region and vertex region), so that the impact energy can be absorbed easily.

2. Second Embodiment

Figure 15:
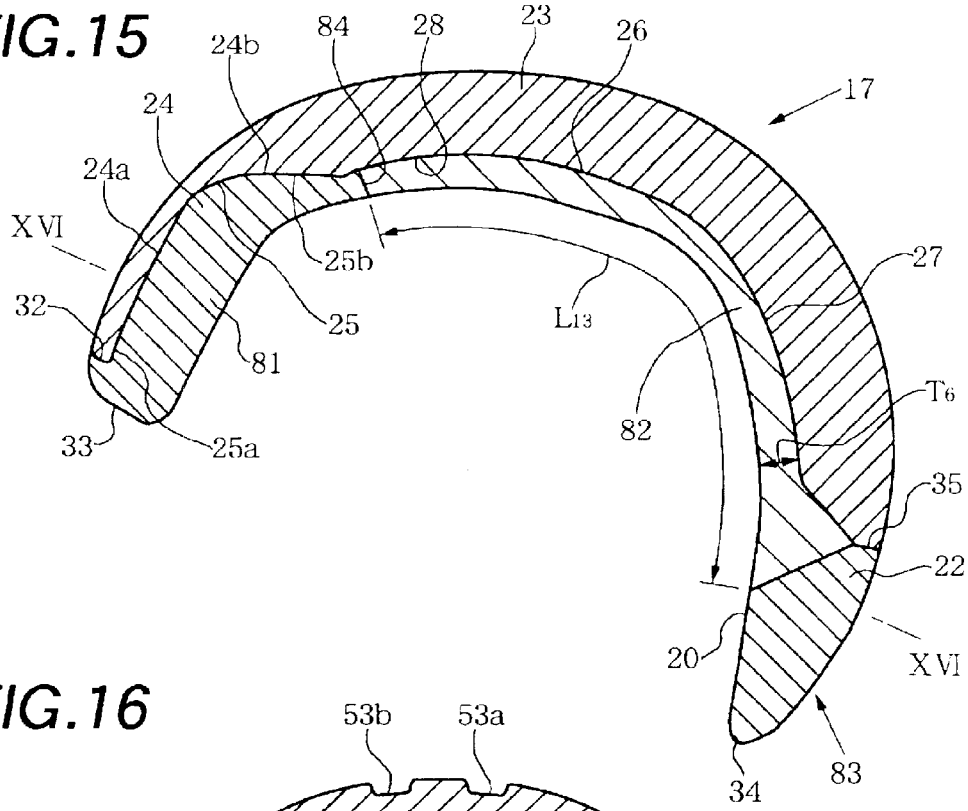
FIG. 15 is a longitudinal sectional view, corresponding to FIG. 7, of an impact-on-the-head absorbing liner according to the second embodiment obtained by applying this invention to a full-face-type helmet.
Figure 16:
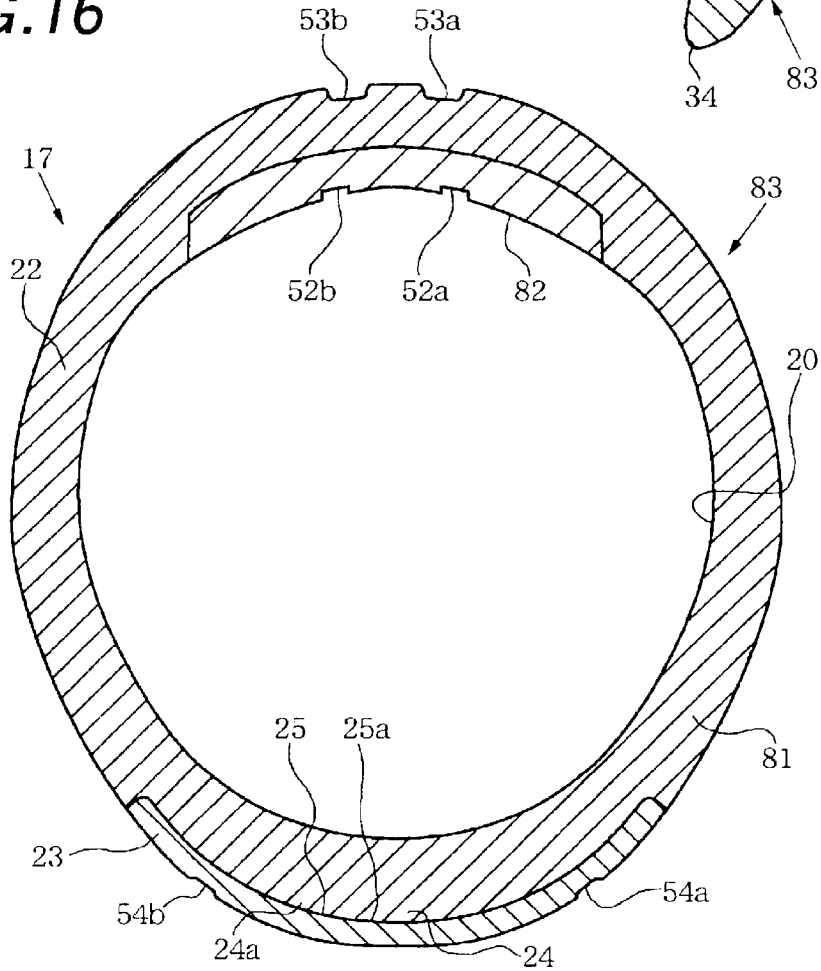
FIG. 16 is a sectional view taken along the line XVI—XVI of FIG. 15.
Figure 27:
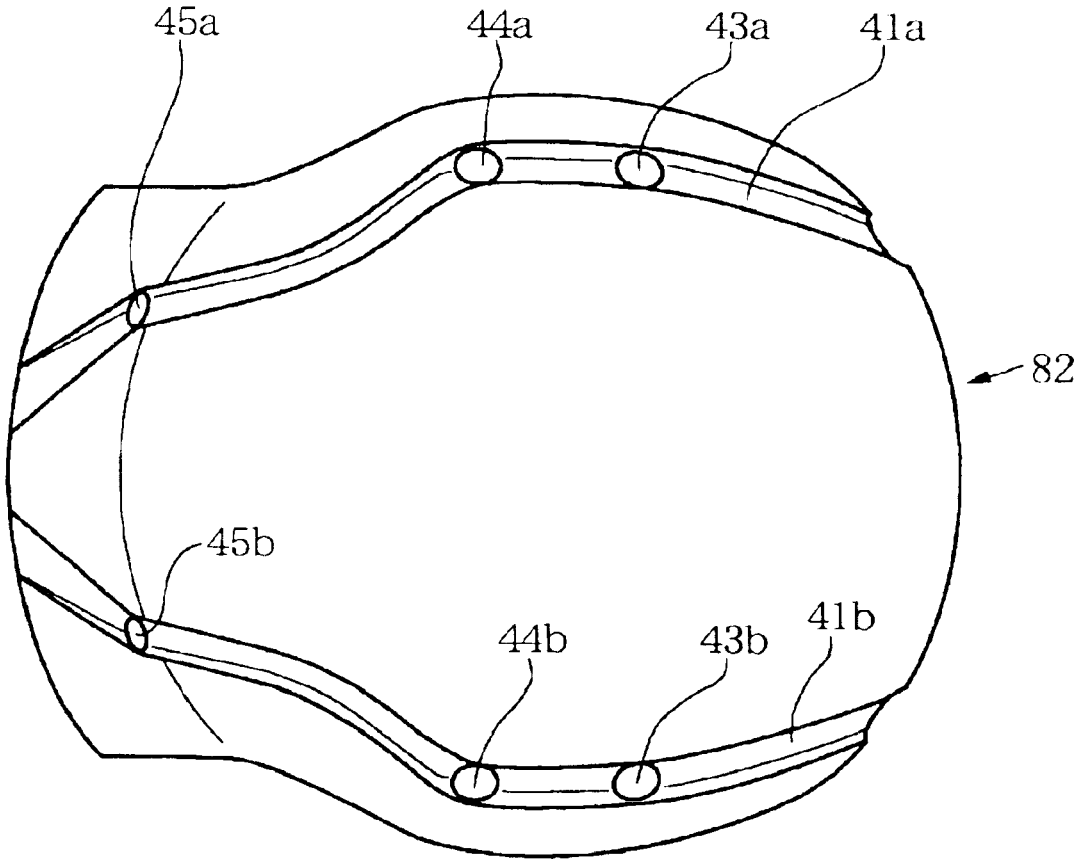
FIG. 27 is a plan view of the central auxiliary liner member shown in FIG. 17.

The second embodiment of this invention shown in FIGS. 15 and 27 can have the same arrangement as that of the first embodiment of this invention except that the main liner member 22 of the first embodiment (see FIGS. 1 and 14) of this invention is altered to a composite main liner member (in other words, first liner member) 83 constituted by a main liner member main body (i.e., a single main liner member) 81 and a central auxiliary liner member (in other words, second auxiliary liner member) 82. In this case, the composite main liner member 83 of the second embodiment of this invention can have substantially the same shape as that of the main liner member 22 of the first embodiment of this invention except that it is constituted by the two liner members. The second embodiment of this invention can accordingly by substantially the same as the first embodiment of this invention except for the above differences and differences to be described later. Portions that are common to the first embodiment of this invention are denoted by the same reference numerals, and a description thereof will be omitted. Hence, only the differences between the first and second embodiments will be described below, and a description on the portions that are common to the first and second embodiments will be omitted. Various types of numerical values of the first embodiment of this invention (i.e., the practical numerical values, preferable numerical value ranges, and further preferable numerical value ranges of the embodiment shown in FIGS. 15 to 27) and other descriptions can be used unchanged by replacing the main liner member 22 with the composite main liner member 83 except for the density.

As shown in FIGS. 15 to 27, according to the second embodiment of this invention, the composite main liner member 83 is constituted by ① the main liner member main body 81 obtained by forming, in the main liner member 22 of the first embodiment (see FIGS. 1 to 14) of this invention, a central opening 84 extending from near the rear end of a swell 24 (or near a position slightly in front of or behind the rear end) to near a rear end 35 of an outer recess 21 (or near a position slightly in front of the rear end 35), and ② the central auxiliary liner member 82 placed and attached to the main liner member main body 81 so as to fit in the central opening 84.

In the embodiment shown in FIGS. 15 to 27, the central opening 84 is formed within a range of the outer recess 21. However, the central opening 84 need not always be limited to this.

The central auxiliary liner member 82 and central opening 84 can have substantially the same shape. The central auxiliary liner member 82 can be formed such that it includes a vertex region, at least partially, near its region formed of the vertex region and the upper half of the occiput region, in the same manner as the central opening 84 (but does not substantially include the swell 24 and a hollow 25 (particularly a tableland 24*a* and lowland 25*a*). Accordingly, the thickness of the central auxiliary liner member 82 near its rear end portion (in other words, the depth of the central opening 84 near its rear end) is sufficiently large when compared to portions other than the portion near the rear end portion, to be similar to the shape of the main liner member 22 of the first embodiment.

The central auxiliary liner member 82 has, in the same manner as the case of the corresponding central region of the main liner member 22 of the first embodiment, (i) a pair of left and right ridge grooves 41*a* and 41*b* excluding a pair of left and right front end portions 85*a* and 85*b*, (ii) a pair of left and right intermediate portions 86*a* and 86*b* of a pair of left and right ridge grooves 52*a* and 52*b*, and (iii) three pairs of left and right through holes 43*a* and 43*b*, 44*a* and 44*b*, and 45*a* and 45*b*.

The ridge grooves 41*a* and 41*b* formed in the outer surface of the central auxiliary liner member 82 and described in the above item (i) are continuous to the front end portions 85*a* and 85*b* formed in the outer surface of the main liner member main body 81 and described in the above item (i). The intermediate portions 86*a* and 86*b* formed in the inner surface of the central auxiliary liner member 82 and described in the above item (ii) are respectively continuous, at their fronts end and rear ends, to a pair of left and right front side portions 87*a* and 87*b* and a pair of left and right rear side portions 88*a* and 88*b* of the pair of left and right ridge grooves 52*a* and 52*b* formed in the inner surface of the main liner member 81.

A maximum value $L_{13}$ (see FIG. 15) of the development length in the back-and-forth direction of the central auxiliary liner member 82 (in other words, the central opening 84) is about 26 cm in the embodiment shown in FIG. 15, but generally preferably falls within a range of 12 cm to 42 cm from the viewpoint of practicality, and further preferably falls within a range of 18 cm to 36 cm. A maximum value $L_{14}$ (see FIG. 17) of the development length in the left-to-right direction of the central auxiliary liner member 82 (in other words, the central opening 84) is about 20 cm in the embodiment shown in FIG. 17, but generally preferably falls within a range of 10 cm to 36 cm from the viewpoint of practicality, and further preferably falls within a range of 14 cm to 28 cm. The development area of the outer surface of the central auxiliary liner member 82 (in other words, the upper open surface of the central opening 84) is about 180 $cm^2$ in the embodiment shown in FIGS. 15 and 17, but generally preferably falls within a range of 60 $cm^2$ to 600 $cm^2$ from the viewpoint of practicality, and further preferably falls within a range of 100 $cm^2$ to 360 $cm^2$.

Figure 17:
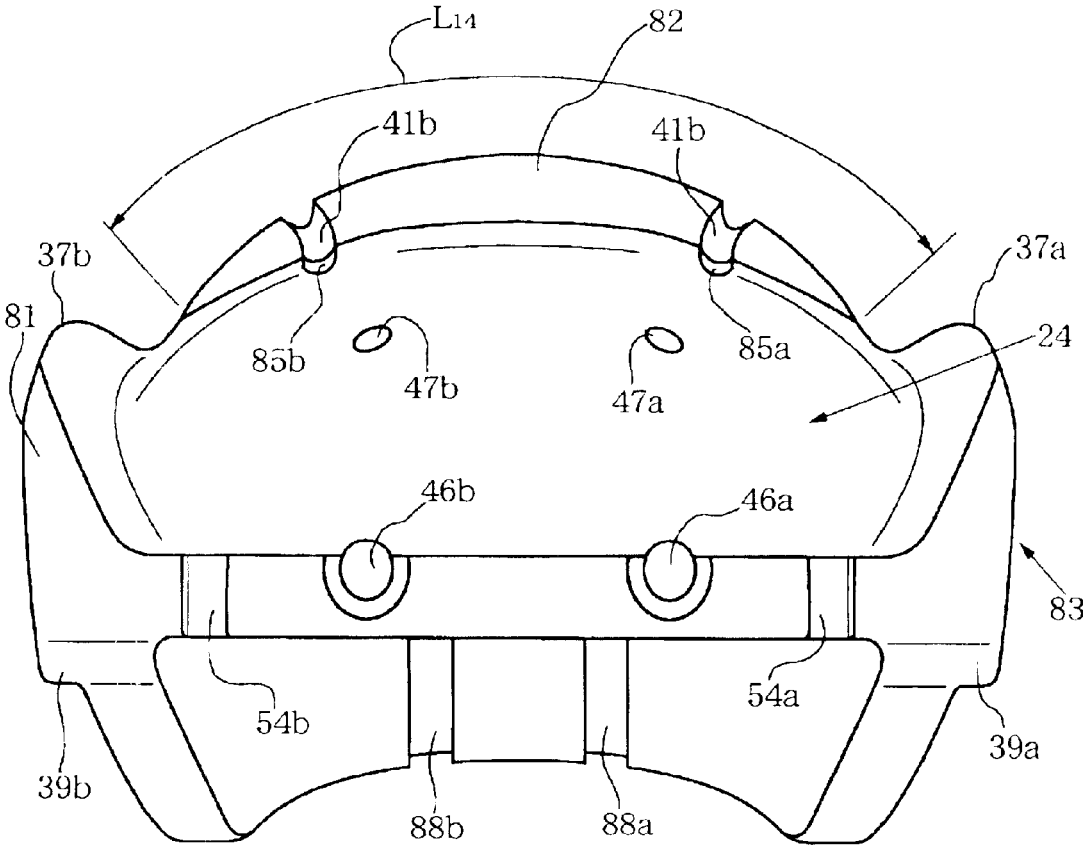
FIG. 17 is a front view of the composite main liner member shown in FIG. 15.
Figure 18:
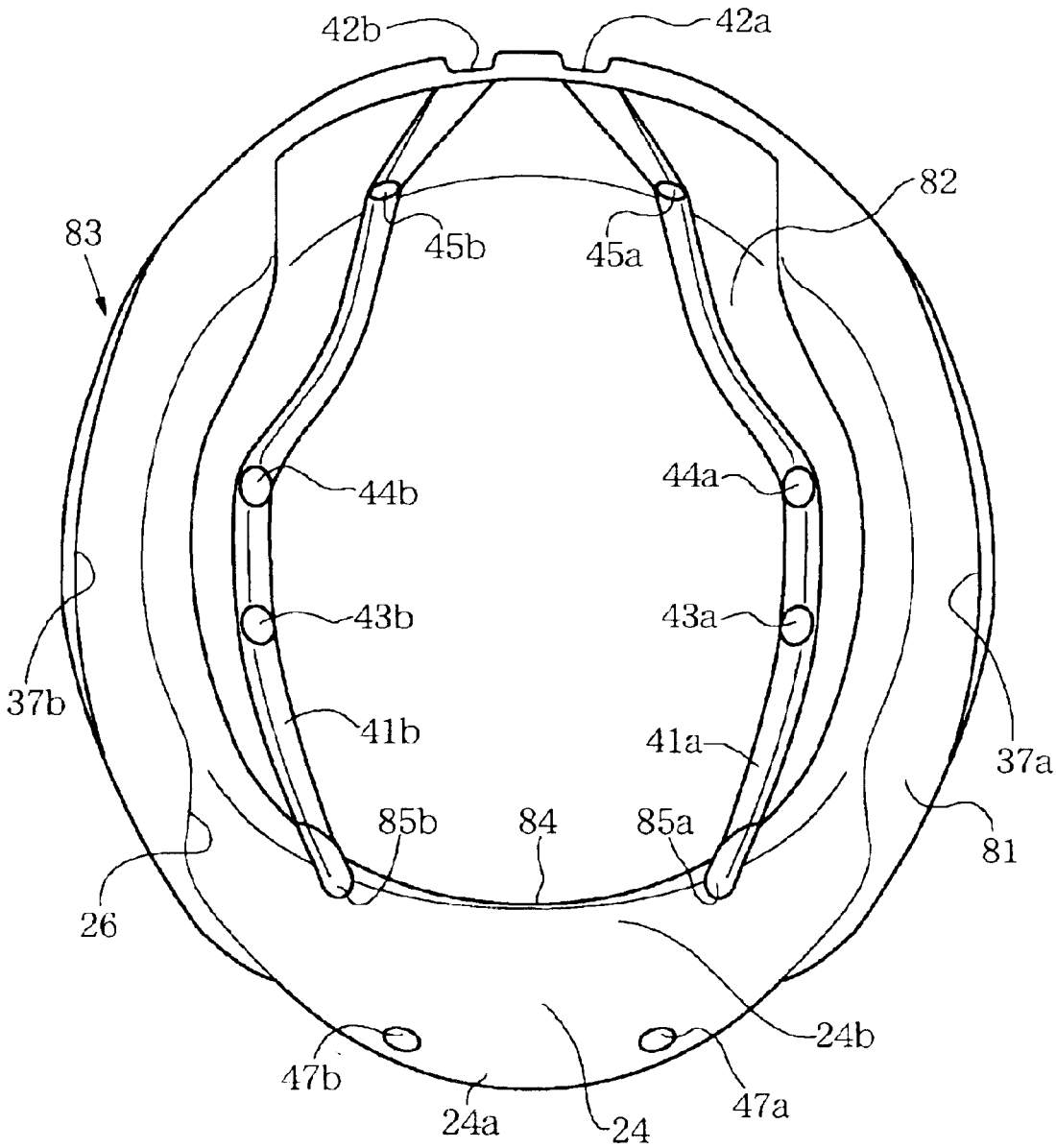
FIG. 18 is a plan view of the composite main liner member shown in FIG. 17.
Figure 19:
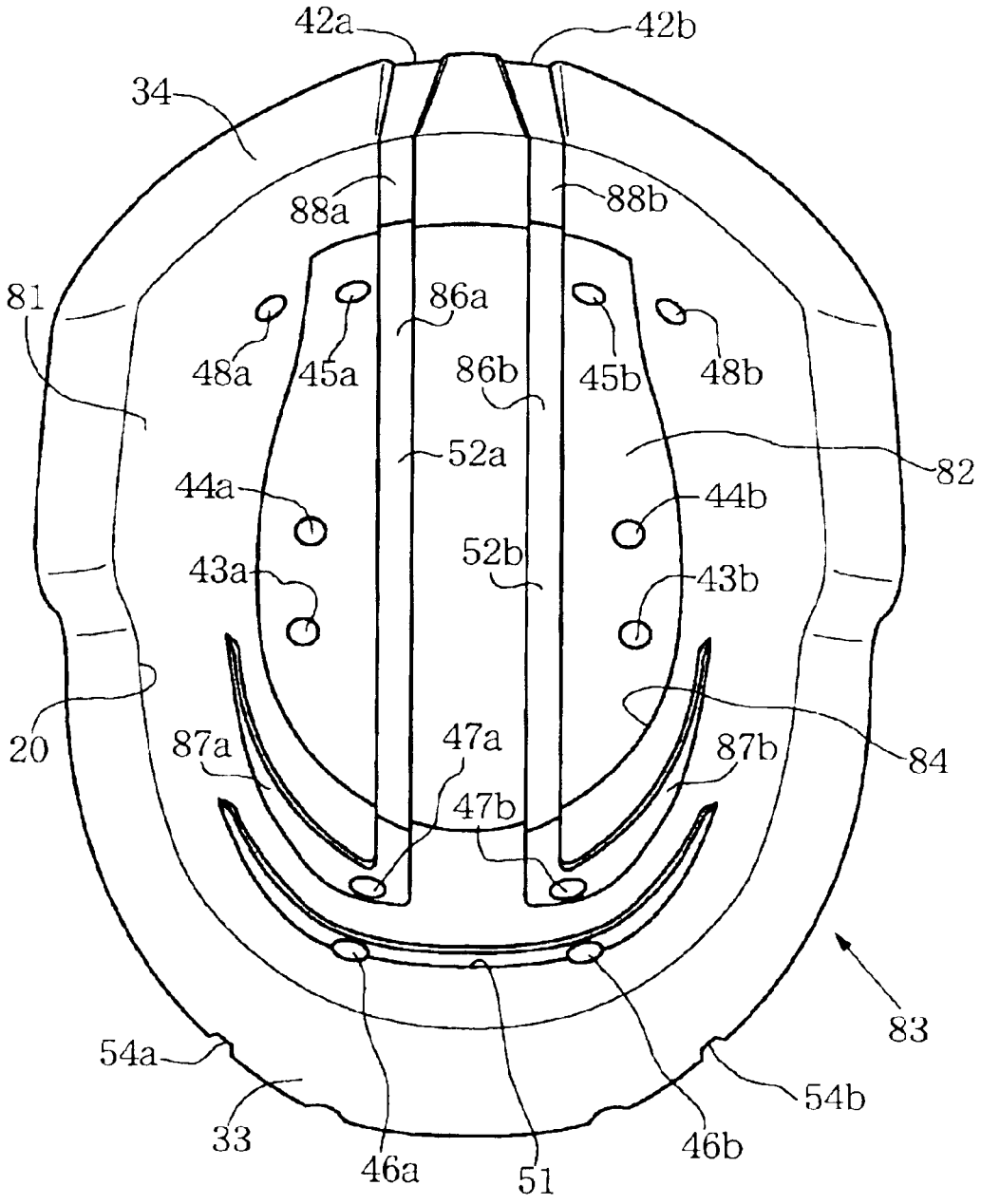
FIG. 19 is a bottom view of the composite main liner member shown in FIG. 17.
Figure 20:
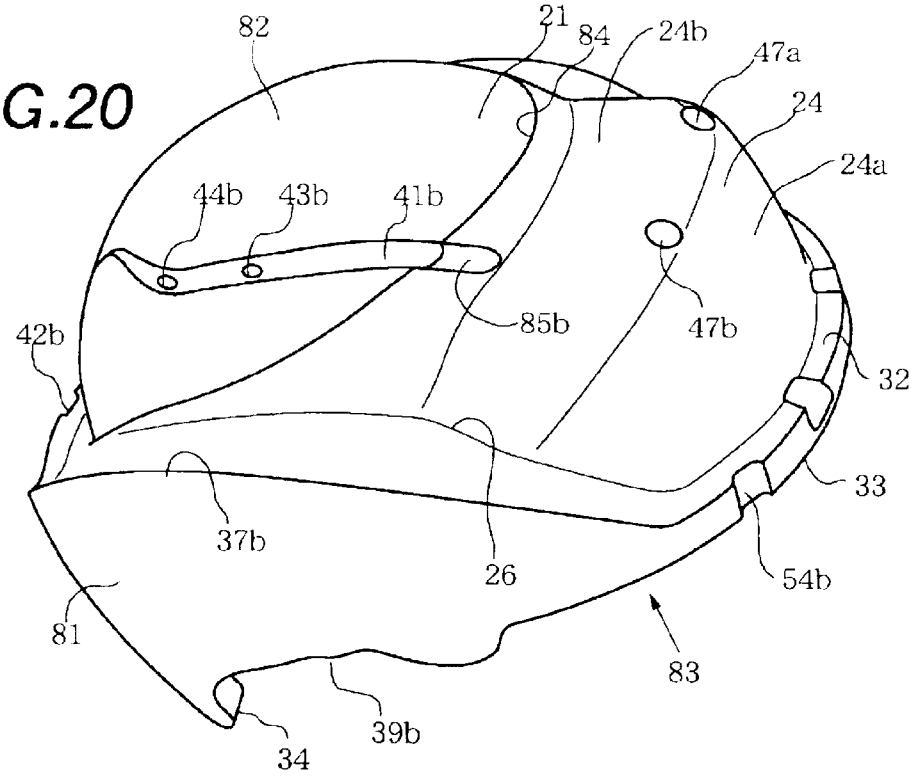
FIG. 20 is a perspective view, seen from obliquely ahead of the upper right, of the composite main liner member shown in FIG. 17.
Figure 21:
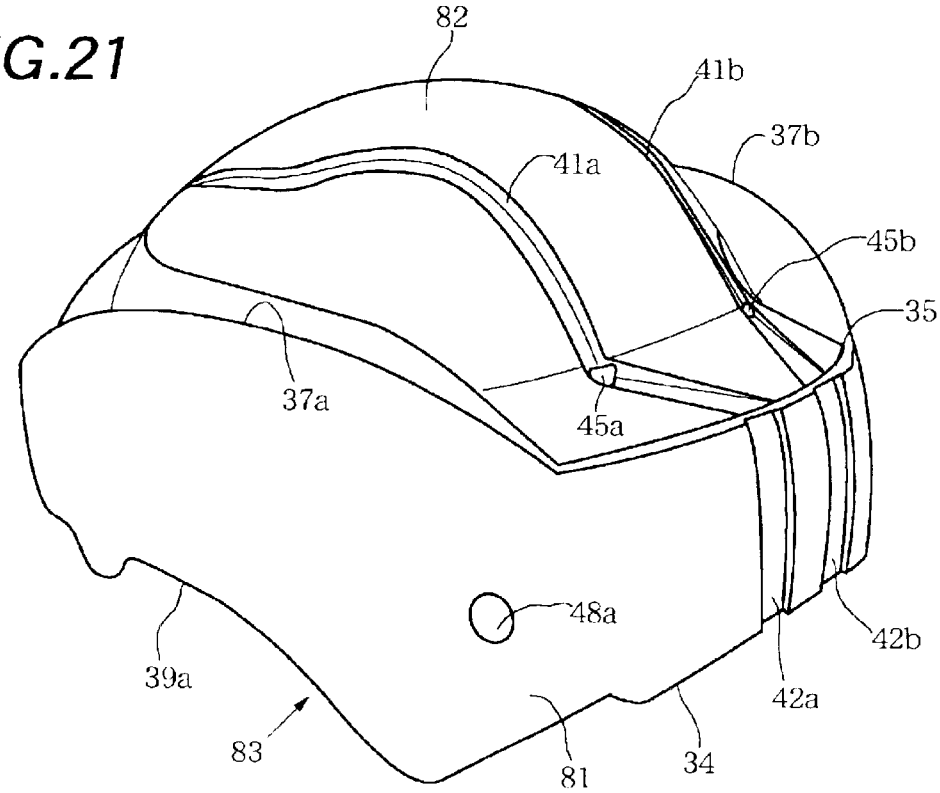
FIG. 21 is a perspective view, seen from obliquely behind the upper left, of the composite main liner member shown in FIG. 17.
Figure 22:
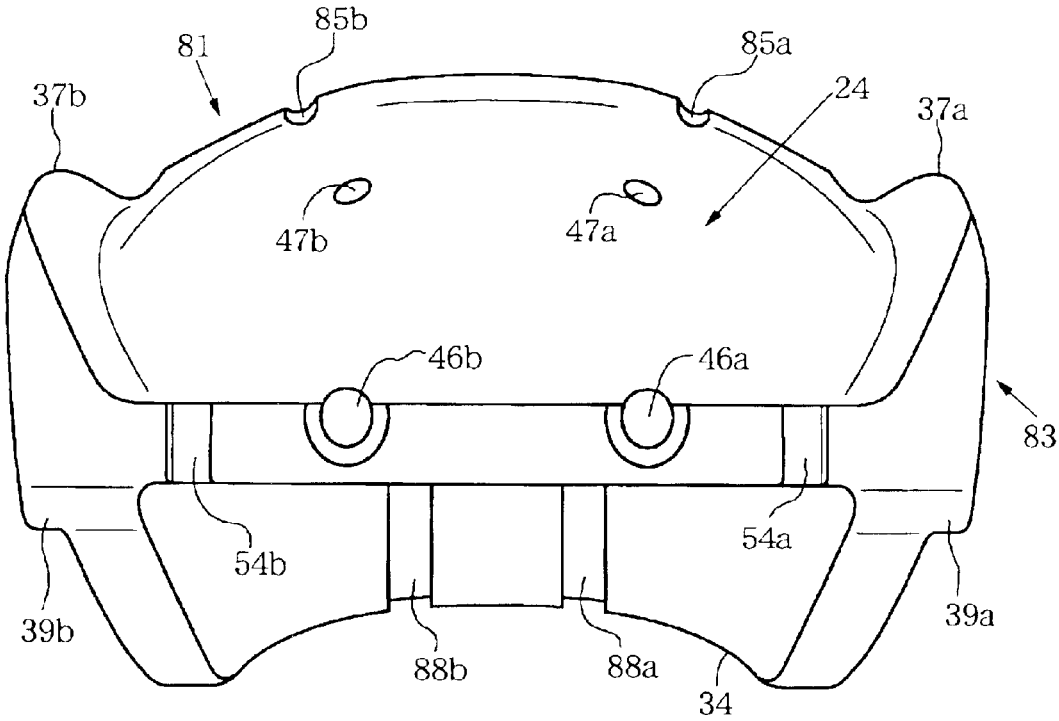
FIG. 22 is a front view of the main liner member main body shown in FIG. 17.
Figure 23:
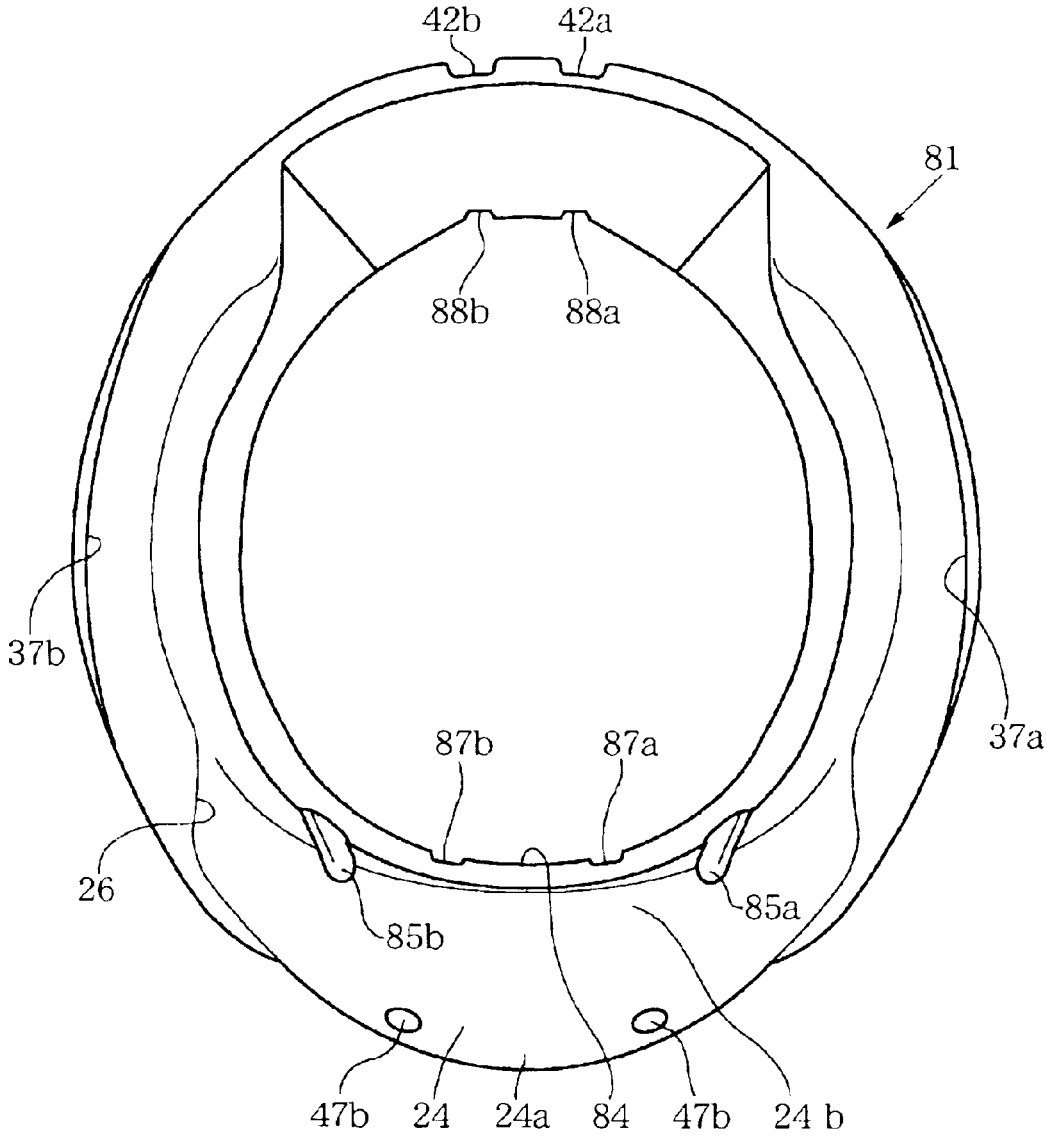
FIG. 23 is a plan view of the main liner member main body shown in FIG. 22.
Figure 24:
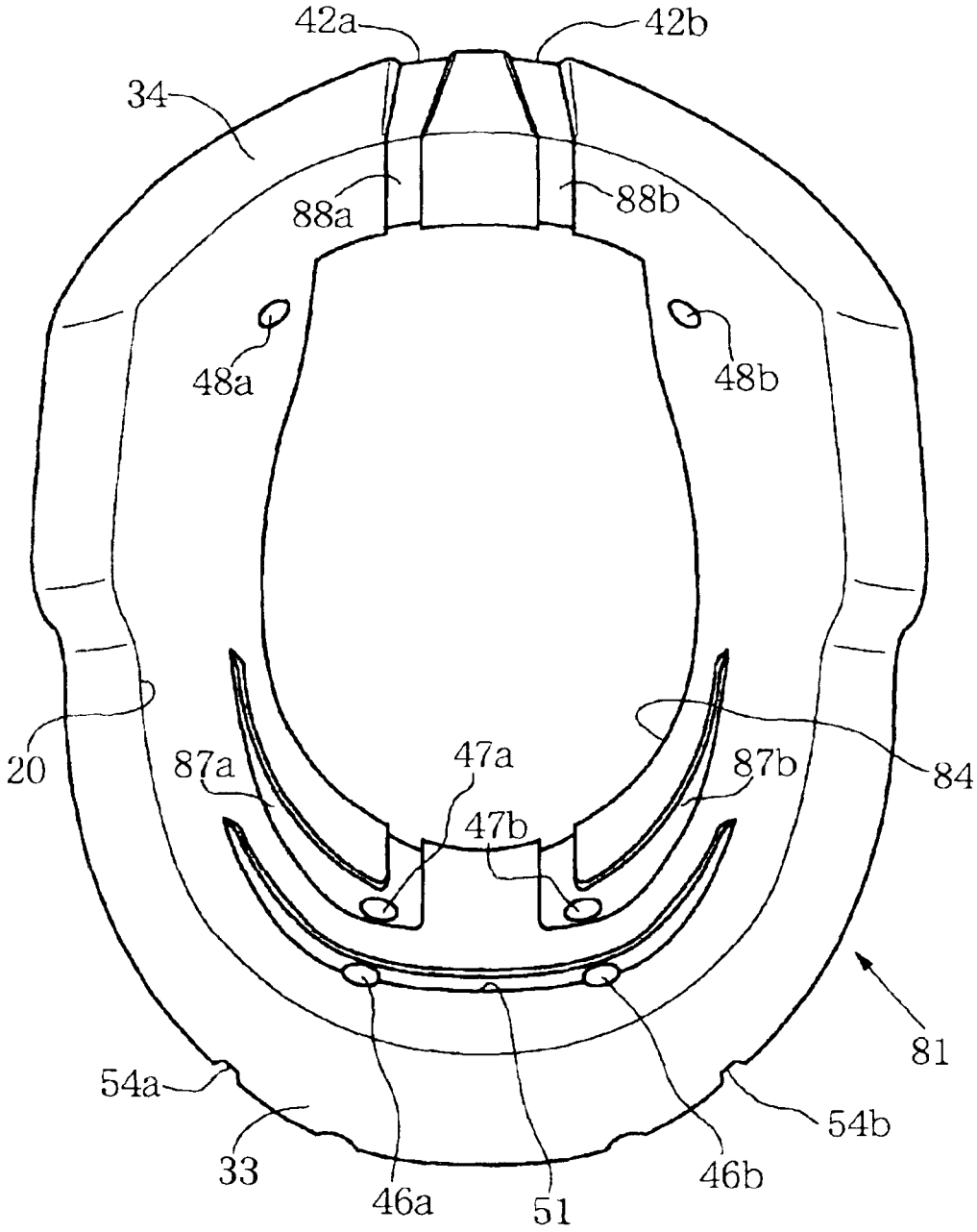
FIG. 24 is a bottom view of the main liner member main body shown in FIG. 22.
Figure 25:
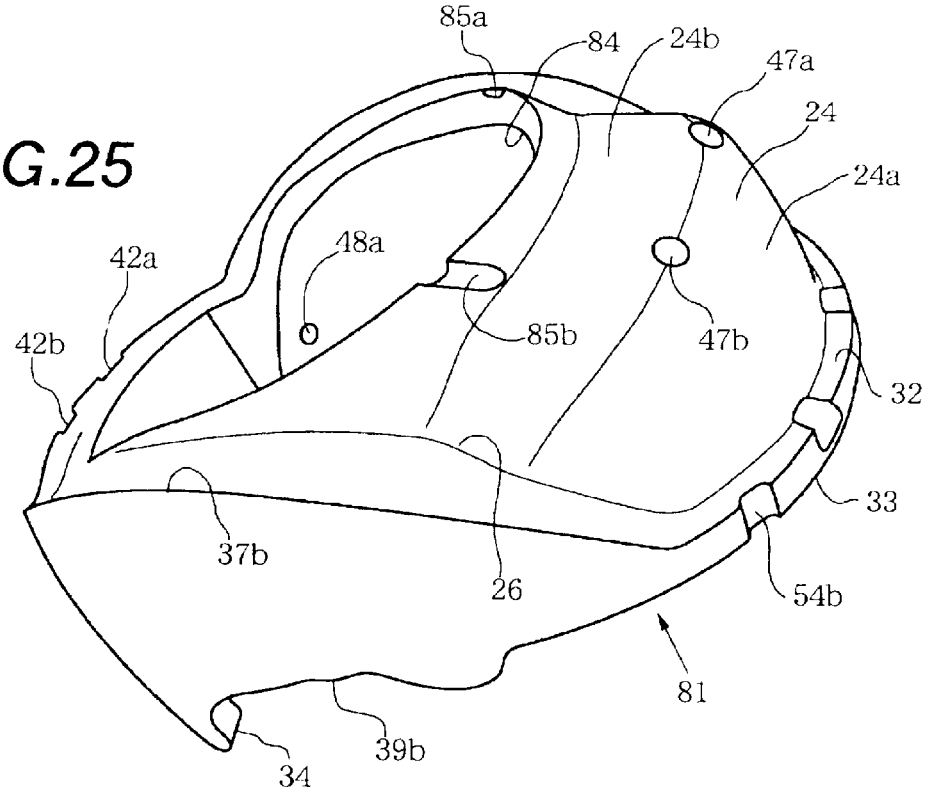
FIG. 25 is a perspective view, seen from obliquely ahead of the upper right, of the main liner member main body shown in FIG. 22.
Figure 26:
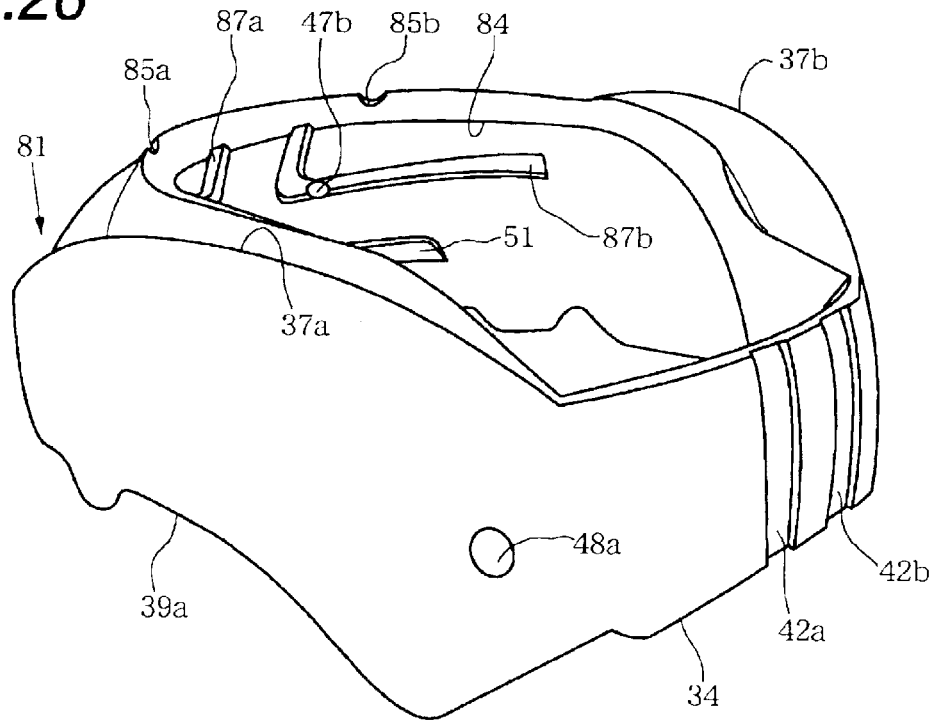
FIG. 26 is a perspective view, seen from obliquely behind the upper left, of the main liner member main body shown in FIG. 22.

The practical numerical values, preferable numerical values ranges, and further preferable numerical value ranges of the embodiment shown in FIGS. 15 and 17 concerning the density of the main liner member main body 81 of the second embodiment can be substantially the same as those of the main liner member 22 of the first embodiment. The practical numerical values, preferable numerical value ranges, and further preferable numerical value ranges of the embodiment shown in FIGS. 15 and 17 concerning the density of the central auxiliary liner member 82 can be substantially the same as those of the outer auxiliary liner member 23 of the first embodiment (in other words, the second embodiment). Hence, in the second embodiment, the practical numerical values, preferable numerical value ranges, and further preferable numerical value ranges of the embodiment shown in FIGS. 15 and 17 concerning the percentage of the density of the central auxiliary liner member 82 (in other words, the outer auxiliary liner member 23) to the density of the main liner member main body 81 can be substantially the same as those of the percentage of the density of the outer auxiliary liner member 23 to the density of the main liner member 22 of the first embodiment. The percentage of the density of the central auxiliary liner member 82 to the density of the outer auxiliary liner member 23 is about 100% in the embodiment shown in FIG. 15, but generally preferably falls within a range of 60% to 167% from the viewpoint of practicality, and further preferably falls within a range of 75% to 133%. The density of the composite main liner member 83 (i.e., the average density of the composite member of the main liner member main body 81 and central auxiliary liner member 82) is slightly smaller than the density of the main liner member main body 81, but its preferable numerical value range and its further preferable numerical value range can be substantially the same as those of the main liner member 22 of the first embodiment.

The practical numerical value, preferable numerical value range, and further preferable numerical value range of the embodiment shown in FIG. 15 concerning an average thickness $T_6$ (see FIG. 15) of the central auxiliary liner member 82 can be substantially the same as those of the average thickness $T_2$ (see FIG. 7) of the non-swelling region 27 of the outer recess 21 of the main liner member 22 of the first embodiment, in the same manner as the average depth of the central opening 84. The ratio of the development area of the outer surface of the central auxiliary liner member 82 to the development area of a non-swelling region 27 of a bottom surface 26 of the outer recess 21 of the composite main liner member 83 (in other words, a non-hollow region 28 of the inner surface of an outer auxiliary liner member 23) is about 0.35 in the embodiment shown in FIGS. 15 to 27, but generally preferably falls within a range of 0.18 to 0.8 from the viewpoint of practicality, and further preferably falls within a range of 0.25 to 0.60.

According to the second embodiment, the central opening 84 (in other words, the central auxiliary liner member 82) is tapered from the outer surface side toward the inner surface side, so that the central auxiliary liner member 82 can fit in the central opening auxiliary liner member 82 and central opening 84 may be tapered from the inner surface sides toward the outer surface side, so that the central auxiliary liner member 82 can be fitted in the central opening 84 from the inner surface side. Also, the shapes of the central auxiliary liner member 82 and central opening 84 may be changed, so that the central auxiliary liner member 82 can be fitted in the central opening 84 from either the outer surface side or inner surface side. Furthermore, when the central auxiliary liner member 82 is to be fitted in the central opening 84, the central auxiliary liner member 82 may be adhered or taped to a portion around the central opening 84 or the like.

In the second embodiment described above, the main liner member main body 81 has the vertically carrying-through central opening 84. Alternatively, in place of the central opening 84, the main liner member main body 81 may have a central recess (a recess shalloeer than the central opening 84 slightly) in the inner or outer surface side of the main liner member main body 81 to have substantially the same shape as that of the central opening 84. The central auxiliary liner member 82 having substantially the same shape as that of the central recess may be fitted in the central recess. In this case, each of the through hole 44*a*, a through hole 57*a*, the through hole 44*b* and a through hole 57*b* extending through an impact-on-the-head absorbing liner 17 from the inner surface side to the outer surface side must commonly extend through three liner members (i.e., the central auxiliary liner member 82, main liner member main body 81 and outer auxiliary liner member 23). Accordingly, fabrication of the through holes 44*a* and 57*a*, and 44*b* and 57*b* is somewhat cumbersome.

In a head protecting body 10 of the second embodiment having the above arrangement, a portion near the vertex region of the impact-on-the-head absorbing liner 17 deforms its outer shape by an impact more effectively than in the first embodiment, to disperse and absorb the impact energy effectively and to decrease its thickness effectively, so that the impact energy is absorbed effectively. Hence, in the helmet having the head protecting body of the second embodiment, both the maximum acceleration during the impact and the HIC decrease much more than in the first embodiment.

3. Third Embodiment

Figure 28:
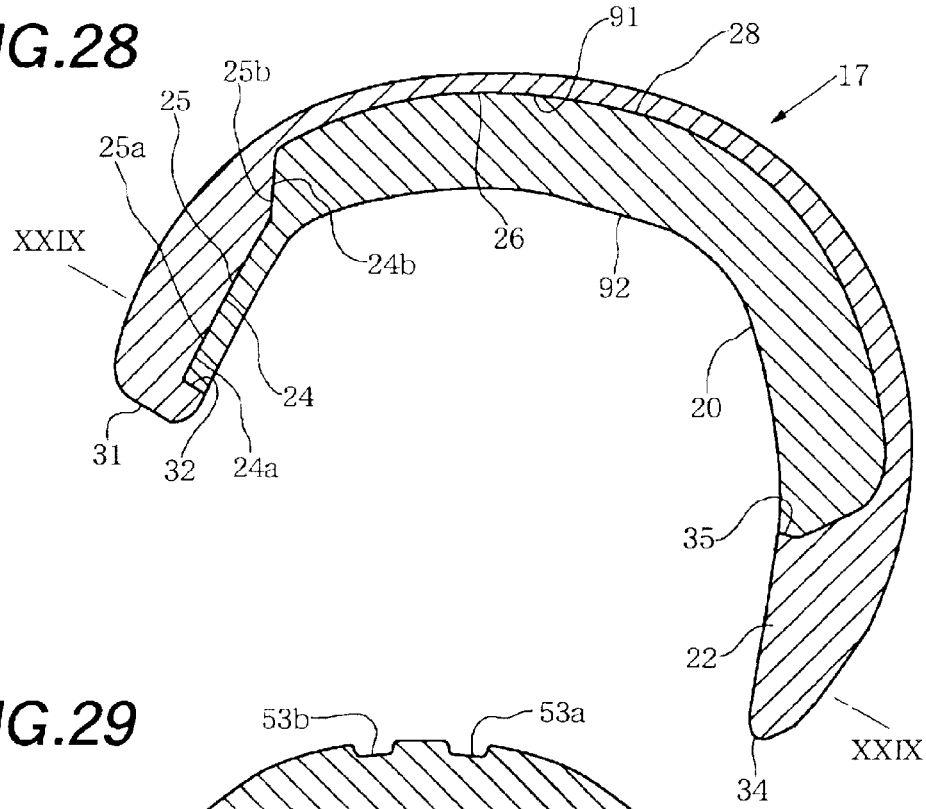
FIG. 28 is a longitudinal sectional view, corresponding to FIG. 7, of an impact-on-the-head absorbing liner according to the third embodiment obtained by applying this invention to a full-face-type helmet.
Figure 29:
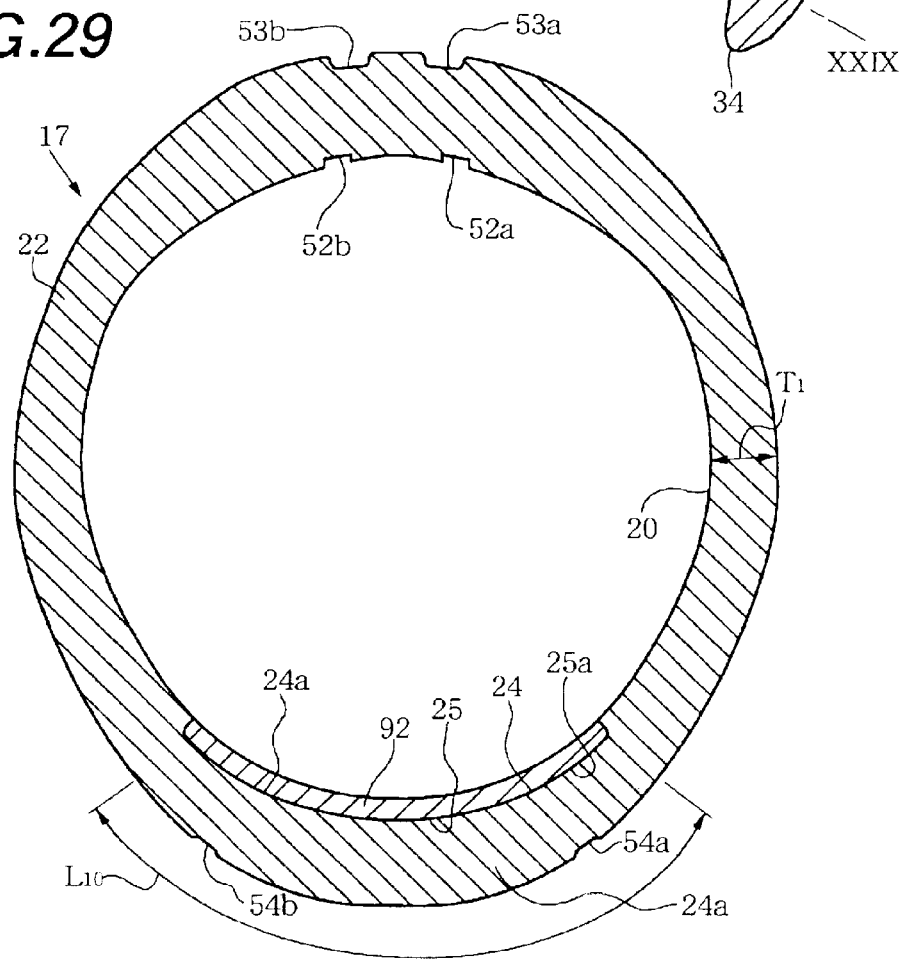
FIG. 29 is a sectional view taken along the line XXIX—XXIX of FIG. 28.

The third embodiment of this invention shown in FIGS. 28 and 29 is obtained by reversing, in the first embodiment of this invention (see FIGS. 1 to 14), the positional relationship between the inner surface side and outer surface side of the main liner member 22, recess 21 and auxiliary liner member 23. Accordingly, in the third embodiment, in place of the outer recess 21 of the first embodiment, an inner recess (in other words, surface recess) 91 is formed in the inner surface of a main liner member 22. In the third embodiment, in place of the outer auxiliary liner member 23 of the first embodiment, an inner auxiliary liner member (in other words, second liner member) 92 is placed and fitted in the inner recess 91. The third embodiment of this invention can be substantially the same as the first embodiment of this invention except for the above differences and differences to be described later. Portions that are common to the first embodiment of this invention are denoted by the same reference numerals, and a description thereof will be omitted. Hence, in the following description, only the differences between the first and third embodiments will be described, and a description on the portions common to the first and third embodiments will be omitted. Furthermore, the various types of numerical values of the first embodiment of this invention (i.e., the practical numerical values, preferable numerical value ranges and further preferable numerical value ranges of the embodiment shown in FIGS. 1 to 14) and other descriptions can be used unchanged by replacing the outer recess 21 and outer auxiliary liner member 23 with the inner recess 91 and inner auxiliary liner member 92, respectively.

According to the third embodiment of this invention, as shown in FIGS. 28 and 29, a swell 24 is formed on the inner surface of the main liner member 22, and a hollow 25 is formed in the outer surface of the inner auxiliary liner member 92. The lengths in the back-and-forth direction and left-to-right direction of the inner recess 91 (in other words, the inner auxiliary liner member 92) can be decreased, when necessary, until the inner auxiliary liner member 92 can be fitted in the inner recess 91 of the main liner member 22 easily. If the inner auxiliary liner member 92 (in some case, the main liner member 22) is formed of a plurality of members and the plurality of members are adhered or taped to each other or to the main liner member 22 or the like when necessory, the above lengths need not be particularly decreased, or need not be decreased very small.

In the third embodiment, as is apparent from FIG. 28, the rear ends of a pair of left and right intermediate ventilation holes 72 (see FIG. 2) are located on the inner surface of an impact-on-the-head absorbing liner 17. Thus, the intermediate ventilation holes 72 are continuous to a pair of left and right ridge grooves 41*a* and 41*b* at their rear ends. A pair of left and right ridge grooves 42*a* and 42*b* (and, in some case, a pair of left and right through holes 45*a* and 45*b*) need not be formed particularly.

In a head protecting body 10 of the third embodiment having the above arrangement as well, the impact-on-the-head absorbing liner 17 deforms its outer shape by an impact effectively in substantially the same manner as in the first embodiment, to disperse and absorb the impact energy effectively and to decrease its thickness effectively, so that the impact energy is absorbed effectively. Hence, in the helmet having the head protecting body of the third embodiment as well, both the maximum acceleration during the impact and the HIC decrease substantially in the same manner as in the first embodiment. Note that in the third embodiment as well, the main liner member 22 may be a composite main liner member 83 formed of a main liner member main body 81 and central auxiliary liner member 82, in the same manner as in the second embodiment.

Having described specific preferred embodiments of this invention with reference to the accompanying drawings, it is to be understood that the invention is not limited to those precise embodiments, and that various changes and modifications may be effected therein by one skilled in the art without departing from the scope or spirit of the invention as defined in the appended claims.

For example, the safety helmet to which this invention can be applied is not limited to the full-face-type helmet adopted in the first to third embodiments described above. This invention can also be applied to other types of safety helmets, e.g., a jet- or semi-jet-type safety helmet.

In the first to third embodiments described above, grooves such as lattice grooves may be formed in an arbitrary portion such as the inner and/or outer surface of one or a plurality of liner members among the main liner member 22, outer auxiliary liner member 23, main liner member main body 81, central auxiliary liner member 82 and inner auxiliary liner member 92, or a plurality or large number of small projections integrally molded, when necessary, with one or the plurality of liner members may be formed on this arbitrary portion, so that the effect of dispersing and absorbing the impact energy with the impact-on-the-head absorbing liner 17 is improved, or the air permeability may be improved.

According to the first to third embodiments described above, the second liner member (i.e., the outer auxiliary liner member 23 and inner auxiliary liner member 92) is substantially entirely stacked on (i.e., overlaps substantially entirely sith) the first liner member (i.e., the main liner member 22 and composite main liner member 83). Alternatively, for example, if the second liner member partly has the function of the main liner member, the second liner member may overlap partially with on the first liner member.

According to the first to third embodiments described above, the region where the second liner member overlaps with the first liner member is formed of substantially the entire forehead region of the impact-on-the-head absorbing liner, substantially the entire vertex region and the substantial upper half of the occiput region. Alternatively, the stacking region suffices as far as it includes the forehead region at least partly and the vertex region at least partly. Conversely, the first and second liner members may overlap with each other substantially entirely to form a complete double structure, thus forming an impact-on-the-head absorbing liner.

According to the first to third embodiments described above, the swell 24 is formed for reinforcing the forehead region. However, the swell 24 can be at least one that reinforces at least one region of the forehead region, the left temple region, the right temple region and occiput region of the first liner member (i.e., a region of the head region excluding the vertex region). For example, the swell 24 can be formed of a swell for reinforcing the left temple region and a swell for reinforcing the right temple region. In this case, the outer or inner auxiliary liner member 23 and 92 and the outer or inner recess 21 or 91 must extend downward to near the intermediate position or near the lower end positions of the left and right temple regions. The swell 24 may be formed of a swell for reinforcing the occiput region. The swell may be formed of a first swell for reinforcing a portion near the boundary of the left temple region and occiput region (in other words, a region stretching over the rear side portion of the occiput region and the left side portion of the occiput region) and a second swell for reinforcing a portion near the boundary of the right temple region and occiput region (in the other words, a region stretching over the rear side portion of the right temple region and the right side portion of the occiput region). The various types of numerical values (i.e., the practical numerical values, preferable numerical value ranges and further preferable numerical value ranges of the embodiment shown in FIGS. 1 to 14) concerning the forehead region reinforcing swell 24 described in the first embodiment can be applied unchanged to any one of these swells (i.e., the swell for reinforcing the left temple region, the swell for reinforcing the right temple region, the swell for reinforcing the occiput region, and the first and second swells). The swell 24 may have a continuous or intermittent substantially-annular structure to surround the vertex region.

According to the first to third embodiments described above, each of the pair of left and right intermediate ventilation holes 72 is formed of the pair of inner and outer ridge grooves 41*a* and 55*a* (or 41*b* and 55*b*). Alternatively, the intermediate ventilation holes 72 may be formed of only either the inner or outer ridge groove, in the same manner as the outer surface ventilation holes 71 are.

According to the first to third embodiments described above, no ventilation holes like the intermediate ventilation holes 72 are formed between the swell 24 and hollow 25. However, when necessary, a ventilation hole like the intermediate ventilation holes 72 can be formed between the swell 24 and hollow 25.

What is claimed is:

1. A head protecting body for a safety helmet, comprising an outer shell made of a rigid material and an impact-on-the-head absorbing liner arranged inside said outer shell, said impact-on-the-head absorbing liner comprising a first liner member, and a second liner member having a density lower than that of said first liner member and overlapping with said first liner member at least partially, wherein said first liner member comprises a swell for reinforcing at least one region of a forehead region, a left temple region, a right temple region and an occiput region in an overlapping region with respect to said second liner member on an overlapping surface side of said first liner member, said swell having a thickness larger than that of a portion of said first liner member which excludes said swell in said overlapping region, said second liner comprises a hollow having a shape substantially corresponding to said swell in an overlapping region with respect to said first liner member, the hollow having a thickness smaller than that of a portion of said second liner member which excludes the hollow of the overlapping region, and said swell is fitted in the hollow.

2. A head protecting body according to claim 1, wherein said swell is formed only within a region formed of said forehead region and a front half of a vertex region.

3. A head protecting body according to claim 1, wherein said swell is formed only within said forehead region.

4. A head protecting body according to claims 1, wherein said swell includes a forehead region reinforcing swell.

5. A head protecting body according to claim 1,

Wherein said first liner member and said second liner member are both made of a foamed body of a synthetic resin, and a percentage of a density of said second liner member to a density of said first liner member falls within a range of 25% to 85%.

6. A head protecting body according to claim 1,

Wherein said first liner member and said second liner member are both made of a foamed body of a synthetic resin, and a percentage of a density of said second liner member to a density of said first liner member falls within a range of 35% to 75%.

7. A head protecting body according to claim 5, wherein a density of said first liner member falls within a range of 20 g/liter to 70 g/liter.

8. A head protecting body according to claim 6, wherein a density of said first liner member falls within a range of 30 g/liter to 60 g/liter.

9. A head protecting body according to claims 7, wherein a density of said second liner member falls within a range of 5 g/liter to 45 g/liter.

10. A head protecting body according to claims 8, wherein a density of said second liner member falls within a range of 10 g/liter to 40 g/liter.

11. A head protecting body according to claim 1, wherein said first liner member comprises a main liner member, said second liner member comprises an auxiliary liner member, a surface recess having a shape substantially corresponding to that of said auxiliary liner member is formed in a surface of said main liner member, and said auxiliary liner member is placed in the surface recess.

12. A head protecting body according to claim 11, wherein said main liner member comprises a single molded product made of a synthetic resin foamed body.

13. A head protecting body according to claim 11, wherein said main liner member comprises a composite main liner member comprising a main liner member main body having a central opening or central recess and a second auxiliary liner member having a density lower than that of said main liner member main body and placed in said central opening or central recess, and said swell is formed substantially on said main liner member main body.

14. A head protecting body according to claim 11, wherein said auxiliary liner member comprises a single molded product made of a synthetic resin foamed body.

15. A head protecting body according to claim 11, wherein said surface recess comprises an outer recess formed in an outer surface of said main liner member.

16. A head protecting body according to claim 11, wherein said surface recess comprises an inner recess formed in an inner surface of said main liner member.

17. A head protecting body according to claim 11, wherein both of said auxiliary liner member and said surface recess extend from said forehead region to said occiput region through a vertex region of said impact-on-the-head absorbing liner, and both of said swell and said hollow are formed substantially in said forehead region.

18. A head protecting body according to claim 11, wherein said swell comprises a tableland, a thickness of which changes relatively small or does not change substantially, and a first thickness transient region extending from said tableland toward a vertex region such that a thickness of said main liner member decreases, and the hollow comprises a lowland, a thickness of which changes comparatively small or does not change substantially, and a second thickness transient region extending from said lowland toward said vertex region such that a thickness of said auxiliary liner member increases.

19. A head protecting body according to claim 11, wherein a development length between a lower end of said forehead region of said main liner member and a front end of said surface recess on a central plane in a left-to-right direction of said impact-on-the-head absorbing liner falls within a range of 0.5 cm to 4.5 cm.

20. A head protecting body according to claim 11, wherein a development length between a lower end of said forehead region of said main liner member and a front end of said surface recess on a central plane in a left-to-right direction of said impact-on-the-head absorbing liner falls within a range of 1 cm to 3 cm.

21. A head protecting body according to claim 11, wherein a development length between a lower end of said occiput region of said main liner member and a rear end of said surface recess on a central plane in a left-to-right direction of said impact-on-the-head absorbing liner falls within a range of 1 cm to 12 cm.

22. A head protecting body according to claim 11, wherein a development length between a lower end of said occiput region of said main liner member and a rear end of said surface recess on a central plane in a left-to-right direction of said impact-on-the-head absorbing liner falls within a range of 2.5 cm to 5.8 cm.

23. A head protecting body according to claim to 11, wherein a development length between a lower end of said left temple region of said main liner member and a left side end of said surface recess, and a development length between a lower end of said right temple region of said main liner member and a right side end of said surface recess, on a central plane in a back-and-forth direction of said impact-on-the-head absorbing liner, both fall within a range of 4 cm to 18 cm.

24. A head protecting body according to claim to 11, wherein a development length between a lower end of said left temple region of said main liner member and a left side end of said surface recess, and a development length between a lower end of said right temple region of said main liner member and a right side end of said surface recess, on a central plane in a back-and-forth direction of said impact-on-the-head absorbing liner, both fall within a range of 6 cm to 15 cm.

25. A head protecting body according to claim 11, wherein a development length of an open surface of said surface recess on a central plane in a left-to-right direction of said impact-on-the-head absorbing liner falls within a range of 20 cm to 55 cm.

26. A head protecting body according to claim 11, wherein a development length of an open surface of said surface recess on a central plane in a left-to-right direction of said impact-on-the-head absorbing liner falls within a range of 30 cm to 50 cm.

27. A head protecting body according to claim 11, wherein a development length of an open surface of said surface recess on a central plane in a left-to-right direction of said impact-on-the-head absorbing liner falls within a range of 15 cm to 50 cm.

28. A head protecting body according to claim 11, wherein a development length of an open surface of said surface recess on a central plane in a left-to-right direction of said impact-on-the-head absorbing liner falls within a range of 20 cm to 40 cm.

29. A head protecting body according to claim 11, wherein development lengths in a left-to-right direction of front and rear ends of said surface recess fall within a range of 8 cm to 26 cm.

30. A head protecting body according to claim 11, wherein development lengths in a left-to-right direction of front and rear ends of said surface recess fall within a range of 12 cm to 22 cm.

31. A head protecting body according to claim 18, wherein average development lengths in a back-and-forth direction of said tableland and said lowland fall within a range of 2.5 cm to 12 cm.

32. A head protecting body according to claim 18, wherein average development lengths in a back-and-forth direction of said tableland and said lowland fall within a range of 4 cm to 9 cm.

33. A head protecting body according to claim 18, wherein average development lengths in a left-to-right direction of said tableland and said lowland fall within a range of 9 cm to 28 cm.

34. A head protecting body according to claim 18, wherein average development lengths in a left-to-right direction of said tableland and said lowland fall within a range of 13 cm to 24 cm.

35. A head protecting body according to claim 18, wherein development lengths in a back-and-forth direction of said first and second thickness transient regions fall within a range of 1 cm to 6 cm.

36. A head protecting body according to claim 18, wherein development lengths in a back-and-forth direction of said first and second thickness transient regions fall within a range of 2 cm to 4.5 cm.

37. A head protecting body according to claim 18, wherein development lengths in a left-to-right direction of said first and second thickness transient regions fall within a range of 11 cm to 32 cm.

38. A head protecting body according to claim 18, wherein development lengths in a left-to-right direction of said first and second thickness transient regions fall within a range of 15 cm to 28 cm.

39. A head protecting body according to claims 11, wherein development areas of said tableland and said lowland fall within a range of 50 $cm^2$ to 220 $cm^2$.

40. A head protecting body according to claims 18, wherein development areas of said tableland and said lowland fall within a range of 75 $cm^2$ to 160 $cm^2$.

41. A head protecting body according to claim 18, wherein development areas of said first and second thickness transient regions fall within a range of 25 $cm^2$ to 140 $cm^2$.

42. A head protecting body according to claim 18, wherein development areas of said first and second thickness transient regions fall within a range of 35 $cm^2$ to 100 $cm^2$.

43. A head protecting body according to claim 18, wherein a development area of a portion of a bottom surface of said surface recess of said main liner member which excludes said swell, and a development area of a portion of an overlapping side surface of said auxiliary liner member which excludes the hollow fall within a range of 250 $cm^2$ to 1,000 $cm^2$.

44. A head protecting body according to claim 18, wherein a development area of a portion of a bottom surface of said surface recess of said main liner member which excludes said swell, and a development area of a portion of an overlapping side surface of said auxiliary liner member which excludes the hollow fall within a range of 400 $cm^2$ to 800 $cm^2$.

45. A head protecting body according to claim 18, wherein a ratio of a development area of said swell to a development area of a portion of a bottom surface of said surface recess of said main liner member which excludes said swell, and a ratio of a development area of the hollow to a development area of a portion of the overlapping side surface of said auxiliary liner member which excludes the hollow fall within a range of 0.1 to 0.6.

46. A head protecting body according to claim 18, wherein a ratio of a development area of said swell to a development area of a portion of a bottom surface of said surface recess of said main liner member which excludes said swell, and a ratio of a development area of the hollow to a development area of a portion of the overlapping side surface of said auxiliary liner member which excludes the hollow fall within a range of 0.15 to 0.45.

47. A head protecting body according to claim 18, wherein a ratio of a development area of said tableland to a development area of a portion of a bottom surface of said surface recess of said main liner member which excludes said swell, and a ratio of a development area of said lowland to a development area of a portion of said auxiliary liner member which excludes the hollow fall within a range of 0.06 to 0.5.

48. A head protecting body according to claim 18, wherein a ratio of a development area of said tableland to a development area of a portion of a bottom surface of said surface recess of said main liner member which excludes said swell, and a ratio of a development area of said lowland to a development area of a portion of said auxiliary liner member which excludes the hollow fall within a range of 0.1 to 0.3.

49. A head protecting body according to claim 18, wherein a ratio of a development area of said first thickness transient region to a development area of said tableland, and a ratio of a development area of said second thickness transient region to a development area of said lowland fall within a range of 0.25 to 1.2.

50. A head protecting body according to claim 18, wherein a ratio of a development area of said first thickness transient region to a development area of said tableland, and a ratio of a development area of said second thickness transient region to a development area of said lowland fall within a range of 0.35 to 0.9.

51. A head protecting body according to claim 11, wherein an average thickness of a portion of said main liner member which excludes a portion where said surface recess is formed falls within a range of 1.5 cm to 8 cm.

52. A head protecting body according to claim 11, wherein an average thickness of a portion of said main liner member which excludes a portion where said surface recess is formed falls within a range of 2.5 cm to 6 cm.

53. A head protecting body according to claim 11, wherein an average thickness of a portion of said surface recess of said main liner member which excludes a swell falls within a range of 0.5 cm to 3 cm.

54. A head protecting body according to claim 11, wherein an average thickness of a portion of said surface recess of said main liner member which excludes a swell falls within a range of 0.8 cm to 2.4 cm.

55. A head protecting body according to claim 18, wherein an average thickness of said tableland of said main liner member falls within a range of 1 cm to 6 cm.

56. A head protecting body according to claim 18, wherein an average thickness of said tableland of said main liner member falls within a range of 1.5 cm to 4.5 cm.

57. A head protecting body according to claim 18, wherein an average thickness of a portion of said auxiliary liner member which excludes the hollow, and an average depth of a portion of said surface recess of said main liner member which excludes said swell fall within a range of 0.8 cm to 5 cm.

58. A head protecting body according to claim 18, wherein an average thickness of a portion of said auxiliary liner member which excludes the hollow, and an average depth of a portion of said surface recess of said main liner member which excludes said swell fall within a range of 1.4 cm to 4 cm.

59. A head protecting body according to claim 18, wherein an average thickness of a lowland of said auxiliary liner member falls within a range of 0.3 cm to 2 cm.

60. A head protecting body according to claim 18, wherein an average thickness of a lowland of said auxiliary liner member falls within a range of 0.5 cm to 1.5 cm.

61. A head protecting body according to claim 18, wherein a ratio of an average thickness of said tableland to an average thickness of a portion of a bottom surface of said surface recess of said main liner member which excludes said swell falls within a range of 1.2 to 4.

62. A head protecting body according to claim 18, wherein a ratio of an average thickness of said tableland to an average thickness of a portion of a bottom surface of said surface recess of said main liner member which excludes said swell falls within a range of 1.5 to 3.

63. A head protecting body according to claim 18, wherein a ratio of an average thickness of said lowland to an average thickness of a portion of said auxiliary liner member which excludes the hollow falls within a range of 1/5 to 4/5.

64. A head protecting body according to claim 18, wherein a ratio of an average thickness of said lowland to an average thickness of a portion of said auxiliary liner member which excludes the hollow falls within a range of 3/10 to 3/5.

65. A head protecting body according to claim 18, wherein a ratio of an average thickness of a portion of said auxiliary liner member which excludes a hollow to an average thickness of a portion of said surface recess of said main liner member which excludes said swell falls within a range of 1/2 to 4.

66. A head protecting body according to claim 18, wherein a ratio of an average thickness of a portion of said auxiliary liner member which excludes a hollow to an average thickness of a portion of said surface recess of said main liner member which excludes said swell falls within a range of 1 to 3.

67. A head protecting body according to claim 18, wherein a ratio of an average thickness of said lowland of said auxiliary liner member to an average thickness of said tableland of said main liner member falls within a range of 1/12 to 5/6.

68. A head protecting body according to claim 18, wherein a ratio of an average thickness of said lowland of said auxiliary liner member to an average thickness of said tableland of said main liner member falls within a range of 1/6 to 2/3.

69. A head protecting body according to claim 18, wherein a ratio of an average thickness of said tableland to an average thickness of a portion of said main liner member which excludes a portion where said surface recess is formed falls within a range of 1/2 to 7/8.

70. A head protecting body according to claim 18, wherein a ratio of an average thickness of said tableland to an average thickness of a portion of said main liner member which excludes a portion where said surface recess is formed falls within a range of 2/3 to 5/6.

71. A head protecting body according to claim 13, wherein each of said main liner member main body and said second auxiliary liner member is made of a foamed body of a synthetic resin, and a percentage of a density of said second auxiliary liner member to a density of said main liner member main body falls within a range of 25% to 85%.

72. A head protecting body according to claim 13, wherein each of said main liner member main body and said second auxiliary liner member is made of a foamed body of a synthetic resin, and a percentage of a density of said second auxiliary liner member to a density of said main liner member main body falls within a range of 35% to 75%.

73. A head protecting body according to claim 13, wherein each of said auxiliary liner member and said second auxiliary liner member is made of a foamed body of a synthetic resin, and a percentage of a density of said second auxiliary liner member to a density of said auxiliary liner member falls within a range of 60% to 167%.

74. A head protecting body according to claim 13, wherein each of said auxiliary liner member and said second auxiliary liner member is made of a foamed body of a synthetic resin, and a percentage of a density of said second auxiliary liner member to a density of said auxiliary liner member falls within a range of 75% to 133%.

75. A head protecting body according to claim 13, wherein a density of said main liner member main body falls within a range of 20 g/liter to 70 g/liter.

76. A head protecting body according to claim 13, wherein a density of said main liner member main body falls within a range of 30 g/liter to 60 g/liter.

77. A head protecting body according to claim 13, wherein a density of said second auxiliary liner member falls within a range of 5 g/liter to 45 g/liter.

78. A head protecting body according to claim 13, wherein a density of said second auxiliary liner member falls within a range of 10 g/liter to 40 g/liter.

79. A head protecting body according to claim 13, wherein a maximum value of a development length in a back-and-forth direction of said second auxiliary liner member and a maximum value of a development length in a back-and-forth direction of said central opening or central recess fall within a range of 12 cm to 42 cm.

80. A head protecting body according to claim 13, wherein a maximum value of a development length in a back-and-forth direction of said second auxiliary liner member and a maximum value of a development length in a back-and-forth direction of said central opening or central recess fall within a range of 18 cm to 36 cm.

81. A head protecting body according to claim 13, wherein a maximum value of a development length in a left-to-right direction of said second auxiliary liner member and a maximum value of a development length in a left-to-right direction of said central opening or central recess fall within a range of 10 cm to 36 cm.

82. A head protecting body according to claim 13, wherein a maximum value of a development length in a left-to-right direction of said second auxiliary liner member and a maximum value of a development length in a left-to-right direction of said central opening or central recess fall within a range of 14 cm to 28 cm.

83. A head protecting body according to claim 13, wherein said swell comprises a tableland, a thickness of which changes relatively small or does not change substantially, and a thickness transient region extending from said tableland toward a vertex region such that a thickness of said main liner member decreases, and a ratio of an average thickness of said tableland of said main liner member to an average thickness of a portion of said main liner member which excludes a portion where said surface recess is formed falls within a range of 1/2 to 7/8.

84. A head protecting body according to claim 13, wherein said swell comprises a tableland, a thickness of which changes relatively small or does not change substantially, and a thickness transient region extending from said tableland toward a vertex region such that a thickness of said main liner member decreases, and a ratio of an average thickness of said tableland of said main liner member to an average thickness of a portion of said main liner member which excludes a portion where said surface recess is formed falls within a range of ⅔ to ⅚.

85. A head protecting body according to claim 13, wherein a development area of an open surface of said central opening or central recess and a development area of a surface of said second auxiliary liner member on a side corresponding to said open surface fall within a range of 60 $cm^2$ to 600 $cm^2$.

86. A head protecting body according to claim 13, wherein a development area of an open surface of said central opening or central recess and a development area of a surface of said second auxiliary liner member on a side corresponding to said open surface fall within a range of 100 $cm^2$ to 360 $cm^2$.

87. A head protecting body according to claim 13, wherein a ratio of a development area of a surface of said second auxiliary liner member on a side opposite to said bottom surface to a development area of a portion of said bottom surface of said surface recess of said composite main liner member which excludes a swell falls within a range of 0.18 to 0.8.

88. A head protecting body according to claim 13, wherein a ratio of a development area of a surface of said second auxiliary liner member on a side opposite to said bottom surface to a development area of a portion of said bottom surface of said surface recess of said composite main liner member which excludes a swell falls within a range of 0.25 to 0.60.

89. A head protecting body according to claim 13, wherein an average thickness of said second auxiliary liner member and an average depth of said central opening or central recess fall within a range of 0.5 cm to 3 cm.

90. A head protecting body according to claim 13, wherein an average thickness of said second auxiliary liner member and an average depth of said central opening or central recess fall within a range of 0.8 cm to 2.4 cm.

91. A head protecting body according to claim 13, wherein said central opening or central recess of said main liner member main body comprises a central opening.

92. A head protecting body according to claim 13, wherein each one of said auxiliary liner member, said main liner member main body and said second auxiliary liner member comprises a single molded product made of a synthetic resin foamed body.

93. A head protecting body according to claim 1, wherein the head protecting body further comprises a ventilation hole formed by an inner surface of said outer shell and a ventilation ridge groove formed in said impact-on-the-head absorbing liner.

94. A head protecting body according to claim 11, wherein the head protecting body further comprises a ventilation hole formed by a ventilation ridge groove formed in said main liner member and/or a ventilation ridge groove formed in said auxiliary liner member.

95. A head protecting body according to claim 1, wherein an average thickness of said outer shell falls within a range of 1 mm to 6 mm.

96. A head protecting body according to claim 1, wherein an average thickness of said outer shell falls within a range of 2 mm to 5 mm.

97. A safety helmet comprising a head protecting body having an outer shell made of a rigid material and an impact-on-the-head absorbing liner arranged inside said outer shell, said impact-on-the-head absorbing liner comprising a first liner member, and a second liner member having a density lower than that of said first liner member and overlapping with said first liner member at least partially, wherein said first liner member comprises a swell for reinforcing at least one region of a forehead region, a left temple region, a right temple region and an occiput region in an overlapping region with respect to said second liner member on an overlapping surface side of said first liner member, said swell having a thickness larger than that of a portion of said first liner member which excludes said swell in said overlapping region, said second liner comprises a hollow having a shape substantially corresponding to said swell in an overlapping region with respect to said first liner member, the hollow having a thickness smaller than that of a portion of said second liner member which excludes the hollow of the overlapping region, and said swell is fitted in the hollow.

* * * * *